United States Patent [19]

Wachi et al.

[11] Patent Number: 5,056,400

[45] Date of Patent: Oct. 15, 1991

[54] MUSICAL INSTRUMENT WITH ELECTRO-ACOUSTIC TRANSDUCER FOR GENERATING MUSICAL TONE

[75] Inventors: Masatada Wachi; Yasuhiko Asahi, both of Hamamatsu, Japan

[73] Assignee: Yamaha Corporation, Hamamatsu, Japan

[21] Appl. No.: 379,437

[22] Filed: Jul. 13, 1989

[30] Foreign Application Priority Data

| | | | |
|---|---|---|---|
| Jul. 20, 1988 | [JP] | Japan | 63-179063 |
| Jul. 20, 1988 | [JP] | Japan | 63-179064 |
| Jul. 20, 1988 | [JP] | Japan | 63-179065 |
| Jul. 30, 1988 | [JP] | Japan | 63-189594 |
| Jul. 30, 1988 | [JP] | Japan | 63-189595 |

[51] Int. Cl.[5] ..... G10H 1/00

[52] U.S. Cl. ..... 84/600; 84/DIG. 17; 84/DIG. 21; 84/723; 84/DIG. 10

[58] Field of Search ..... 84/600, 644, 670, 718, 84/723, 728, 743, 189, 190, 267, 291, DIG. 1, DIG. 17, DIG. 21, DIG. 10

[56] References Cited

U.S. PATENT DOCUMENTS

| | | | |
|---|---|---|---|
| 579,498 | 3/1897 | Schreiber | 84/190 |
| 1,679,290 | 7/1928 | Bessier | 84/189 |
| 2,001,723 | 5/1935 | Hammond, Jr. | 84/1 |
| 2,205,804 | 6/1940 | Wells | 181/31 |
| 2,952,179 | 9/1960 | Andersen | 84/718 X |
| 3,718,747 | 2/1973 | Martin et al. | 84/600 |
| 3,878,748 | 4/1975 | Spence | 84/718 X |
| 4,464,967 | 8/1984 | Trimborn | 84/743 |
| 4,697,491 | 10/1987 | Maloney | 84/1.05 |
| 4,750,400 | 6/1988 | Milne | 84/1.16 |

FOREIGN PATENT DOCUMENTS

| | | |
|---|---|---|
| 63-142393 | 6/1988 | Japan . |

*Primary Examiner*—W. B. Perkey

[57] ABSTRACT

The acoustic apparatus for generating a musical tone preferably adopts a speaker system utilizing a resonator constituted by a cavity and an acoustic mass for causing the cavity to acoustically communicate with an external region or a speaker system utilizing a back-loaded horn so that frequency characteristic is improved. In a musical instrument, including a resonator, like a guitar, all or part of a body is partitioned as the cavity, and acoustic mass such as a resonance port is disposed in the cavity as needed to set a desired resonance frequency. In a musical instrument having side plates or leg portions, the resonance port or the back-loaded horn is housed in the side plates or the leg portions.

5 Claims, 12 Drawing Sheets

MUSICAL INSTRUMENT WITH ELECTRO-ACOUSTIC TRANSDUCER FOR GENERATING MUSICAL TONE

BACKGROUND OF THE INVENTION

1. Field of the Invention

The present invention relates to a musical instrument for electrically generating a musical tone through an electro-acoustic transducer like an electrical or electronic musical instrument and, more particularly, to a musical instrument with a compact electro-acoustic transducer and capable of generating a heavy bass sound and a musical instrument capable of generating a musical tone with good sound quality over the entire tone generation range, in particular, in a bass range.

2. Description of the Prior Art

Conventionally, electronic and electrical musical instruments are known as musical instruments comprising an electro-acoustic transducer (to be referred to as an acoustic apparatus hereinafter).

An electrical musical instrument comprises a tone generating device which can directly generate a tone by a mechanical or acoustic vibration similar to a guitar, drum, wind instrument, or the like. The instrument temporarily converts the mechanical vibration or tone into an electrical signal and electrically amplifies the electrical signal. The instrument re-converts the amplified electrical signal into an acoustic wave using an acoustic apparatus to produce a corresponding sound. Thus, the instrument can generate an acoustic wave in a larger tone volume than that when it is directly generated, or can produce a tone with a special effect.

On the other hand, an electronic musical instrument electrically forms a musical tone signal using an electronic circuit with an oscillator, a memory, and the like in accordance with an instruction from a tone generation instruction means such as a keyboard, drum pad, breath input device, or the like, and produces a sound corresponding to the musical tone signal using an acoustic apparatus.

The electrical/electronic musical instrument is generally equipped with a separate speaker box as a speaker system for the acoustic apparatus. In this case, the speaker box causes an increase in cost or becomes a design limitation factor.

In some instruments, a pedal box serves as a speaker box, and the speaker system is housed in the pedal box. In this case, however, both a box volume and a speaker diameter are reduced, and a bass sound cannot be satisfactorily reproduced.

In the electrical/electronic musical instrument, the frequency characteristic of the acoustic apparatus is fixed. Thus, good sound quality cannot always be obtained over the entire tone range for an electronic keyboard instrument having a wide tone generation range.

As the electrical/electronic musical instrument, a portable musical instrument which incorporates an acoustic apparatus, is easily carried, and has a shape and size suitable for a hand-held performance is also known.

The portable musical instrument is required to have a compact main body in terms of easy carrying and easy standing performance, and a small-diameter speaker is disposed in the compact main body. For this reason, the conventional portable musical instrument cannot satisfactorily reproduce a bass sound and can only produce a poor sound. Some portable musical instruments include a resonator for producing a bass sound. However, the musical instrument of this type has a large main body like an acoustic guitar to obtain sufficient sound quality, and is not suitable for a standing performance. If the instrument of this type has a size suitable for a standing performance, sufficient sound quality cannot be obtained.

SUMMARY OF THE INVENTION

The present invention has been made in consideration of the conventional problems, and has as its first object to provide a portable musical instrument which has dimensions suitable for a portable use and can produce a heavy bass sound.

It is a second object of the present invention to provide an electrical/electronic musical instrument which can improve a bass sound characteristic without particularly increasing outer dimensions or can reduce outer dimensions without impairing a bass sound characteristic, can minimize design limitations, and is advantageous in cost.

It is a third object of the present invention to provide an electronic musical instrument which can obtain good sound quality over a wide tone generation range.

In order to achieve the above objects, according to a first aspect of the present invention, a portable musical instrument main body comprises, as an acoustic apparatus, a resonator constituted by a cavity and acoustic mass means, a vibrator constituting a portion of the resonator and including a vibrating body for driving the resonator with one surface, and vibrator driving means for driving the vibrator to cancel a counteraction from the resonator to a diaphragm of the vibrator when the resonator is driven, thereby positively utilizing resonance of the resonator.

In particular, in a portable electrical musical instrument constituted by assembling an acoustic-electric transducer (pickup) and an acoustic apparatus in a musical instrument which has a resonator in an instrument main body like a guitar or drum and can directly produce a musical tone from the resonator, the resonator of the portable instrument main body is used for the acoustic apparatus directly or by changing a resonance frequency using acoustic mass means if necessary. A vibrator which constitutes a portion of the resonator and comprises a vibrating body for driving the resonator with one surface and for directly radiating an acoustic wave from the other surface to the outside the instrument main body is arranged in the resonator. In addition, a vibrator driving means for driving the vibrator to cancel a counteraction from the resonator to a diaphragm of the vibrator when the resonator is driven is arranged. Thus, resonance of the resonator is positively utilized.

The acoustic apparatus of the conventional electrical/electronic musical instrument is constituted by a speaker system, and a power amplifier, whose output impedance is essentially zero, for constant-voltage driving the speaker system. For this reason, in the conventional musical instrument, an output sound pressure characteristic is influenced by the volume of a cavity behind a diaphragm of the speaker unit. Thus, if the volume of the cavity is reduced to make the resonator or the instrument main body compact, a bass sound characteristic is impaired.

In the first aspect of the present invention, the driving means drives the vibrator to cancel an air counteraction from the resonator (cavity) side to the vibrating body of the vibrator. More specifically, the vibrator is driven in a so-called "dead" state wherein the vibrator is not influenced by the counteraction from the resonator side and is sufficiently damped. For this reason, the frequency characteristic of a directly radiated acoustic wave is not influenced by a space behind a direct radiation surface of the vibrator, i.e., the volume of a housing. The volume of the space can be reduced as long as it can serve as the cavity of the vibrator and a chamber for the vibrator. When viewed from the resonator side, to drive the vibrator to cancel the counteraction from the resonator upon driving of the resonator means that the diaphragm of the vibrator is converted to an equivalent wall which cannot be driven by the resonator. Therefore, the Q value as the resonator is not influenced by the characteristic values ($f_o$, $Q_o$) of the vibrator, and if the resonance frequency is decreased, a sufficiently high Q value can be assured. Thus, if the housing is made compact, the resonator can generate a heavy bass sound (resonance sound) with a sufficient level.

In this manner, according to the first aspect of the present invention, although a small-diameter speaker unit is arranged on a compact instrument main body, resonance of the resonator in the main body is positively utilized to obtain sound quality with a sufficient bass sound characteristic. When the present invention is applied to an electrical musical instrument, e.g., an acoustic guitar, which is large as a portable instrument, the resonator can be rendered compact without impairing sound quality, and the size of the instrument main body can be reduced to be suitable for a standing performance.

According to a second aspect of the present invention, an acoustic apparatus comprises a housing which defines a closed cavity when a vibrator is arranged on its outer wall, a duct formed in a leg portion of a musical instrument and causing the cavity to communicate with an external region, a vibrator, arranged in the housing, for driving a resonator constituted by the cavity and the duct with one surface and for directly radiating an acoustic wave from the other surface, and vibrator driving means for driving the vibrator to cancel a counteraction from the resonator to a diaphragm when the resonator is driven, thereby effectively utilizing resonance of the resonator.

The resonator, the vibrator, and the vibrator driving means in the second aspect are operated in the same manner as in the first aspect.

In the second aspect, the duct constituting the resonator is formed in a leg portion of a musical instrument, thus minimizing a change in appearance due to an addition of the duct. To form the duct in the leg portion means that when the leg portion is constituted by a column or a thick plate, a channel is formed in these members to use it as the duct, or when the leg portion is constituted by a pipe, the pipe is used as the duct.

According to the second aspect of the present invention, a heavy bass sound can be produced using a compact housing, and for a conventional musical instrument which employs a compact housing and a small-diameter vibrator (e.g., dynamic speaker unit), a bass sound characteristic can be improved while using a housing and a vibrator having the same dimensions as those of the conventional instrument. On the other hand, for a conventional musical instrument which employs a large housing and a large-diameter vibrator, the housing and the vibrator can be rendered compact without impairing a bass sound characteristic. The duct is formed in the leg portion of the musical instrument to minimize a change in outer appearance due to an addition of the duct, and the housing can be rendered compact, thus eliminating design limitations of the musical instrument. Since the housing is small in size and the leg portion is used as the duct, factors increasing the cost can be eliminated, thus providing advantages in terms of cost.

In order to achieve the third object, according to a third aspect of the present invention, an electronic musical instrument comprises, as an acoustic apparatus, a resonator constituted by a cavity and acoustic mass means for causing the cavity to acoustically communicate with an external region, a vibrator constituting a portion of the resonator and including a vibrating body for driving the resonator with one surface, vibrator driving means for driving the vibrator to cancel a counteraction from the resonator to the vibrating body when the resonator is driven, and control means for controlling at least one of the resonator and the vibrator driving means to vary a frequency characteristic of the acoustic apparatus.

In the third aspect, the frequency characteristic of the acoustic apparatus is variably controlled. For this reason, a frequency characteristic according to a performance content is set in advance before a performance, or a frequency characteristic is automatically set in accordance with a pitch or tone quality designated during a performance, so that a musical tone with high quality can be produced and a musical tone effect unlike in a conventional apparatus can be realized.

In the conventional acoustic apparatus, the vibrator is constant-voltage driven using the vibrator driving means whose output impedance is essentially zero. In the acoustic apparatus, a bass range reproduction limit of an output sound pressure of an acoustic wave directly radiated from the vibrator (e.g., a speaker) is determined by the characteristic values ($f_o$, $Q_o$) of the vibrator and the volume of the housing (e.g., a speaker cabinet) to which the vibrator is attached. For this reason, in order to arbitrarily vary the frequency characteristic, a large-sized vibrator and housing capable of reproducing a lowest frequency in a variable range are necessary. In order to make the vibrator and the housing compact, the lowest reproduction limit frequency of the speaker system is set to be relatively high, and a shortage of a bass range reproduction level is compensated for by boosting the input signal level of the vibrator driving means. However, in the conventional acoustic apparatus, since the output sound pressure below the bass range reproduction limit is decreased by 12 dB/oct, it is difficult or impossible to satisfactorily compensate for the bass range characteristic. In an acoustic apparatus using a speaker system having a resonator such as a phase-inversion type (bass-reflex type) speaker system, since a direct radiation characteristic of the vibrator has mutual dependency with a resonant radiation characteristic of the resonator, characteristic values must be relatively strictly set to obtain a flat frequency characteristic. If the resonance frequency is varied, in particular, if it is extremely lowered, a drift of 12 dB/oct occurs in a bass range frequency characteristic, and compensation for obtaining a flat characteristic is difficult to achieve.

In the third aspect, the vibrator driving means drives the vibrator to cancel a counteraction from the resonator (cavity) side to the vibrating body of the vibrator in the same manner as in the first and second aspects. Therefore, the frequency characteristic of a directly radiated acoustic wave from the vibrating body of the vibrator is not influenced by the volume of a space behind the direct radiation surface of a diaphragm as in the above aspects. The volume of this space can be reduced as long as the space can serve as the cavity of the resonator and a chamber of the vibrator. The Q value of the resonator is not influenced by the characteristic values ($f_o$, $Q_o$) of the vibrator. Even if the resonance frequency is decreased, a sufficiently high Q value can be assured. Thus, if the cavity, i.e., the housing is reduced in size, a heavy bass sound (resonance sound) with a sufficient level can be generated. In this case, a decrease in output sound pressure of the directly radiated acoustic wave in a range lower than the lowest resonance frequency $f_0$ of the vibrator is 6 dB/oct. The resonance frequency of the resonator can be varied regardless of the direct radiation characteristic. In this case, even if the frequency characteristic drifts, it can be compensated for by 6 dB/oct as in normal tone control, thus obtaining a flat characteristic. The resonance frequency of the resonator can be varied by varying the volume of the cavity or an acoustic mass. The frequency characteristic, in particular, the bass range characteristic can be varied by varying a degree of canceling a counteraction from the resonator in the vibrator driving means.

In this manner, according to the third aspect, since the frequency characteristic of the acoustic apparatus can be changed as needed, the pitch of a performance musical tone is caused to match with the frequency characteristic of the acoustic apparatus, so that a high-quality musical tone can be produced. In addition, a musical tone effect unlike in the conventional apparatus can be obtained in accordance with a combination of the pitch of a performance musical tone and the frequency characteristic of the acoustic apparatus or by changing the combination during a performance.

According to Japanese Patent Application No. Sho 62-334262 filed by the present applicant, a speaker system (acoustic apparatus) capable of reproducing a sound to a bass range with a smaller speaker box is proposed. In this acoustic apparatus, a resonance frequency $f_{op}$ of a Helmholtz resonator constituted by a port and a cabinet is set to be lower than that of a conventional bass-reflex speaker system, and a vibrator (speaker unit) for driving the Helmholtz resonator is driven to cancel an air counteraction from the resonator side when the resonator is driven. The first to third aspects present musical instruments to which such a speaker system is applied. However, in the speaker system, a decrease in electro-acoustic conversion efficiency in the bass range is compensated for by increasing an output from an amplifier circuit such as a negative impedance generator or an MFB circuit. Therefore, a high-power amplifier and a high-withstand input speaker are necessary, resulting in high cost and large power consumption.

It is therefore a fourth object of the present invention to provide a speaker system for an electronic musical instrument which allows bass sound reproduction using a small-diameter speaker, can reduce cost, and can minimize design limitations.

In order to achieve the fourth object, according to a fourth aspect of the present invention, a back-loaded horn is formed in a side plate portion of an electronic musical instrument or a side plate or in a side leg of an instrument stand, and is acoustically coupled to a speaker box of the electronic musical instrument.

With this arrangement, a back-loaded horn speaker system is formed by the speaker box of the electronic musical instrument and the back-loaded horn in the side plate portion. In this back-loaded horn speaker system, a middle/high tone is directly radiated from the front surface of a speaker unit attached to the speaker box, and a bass sound is radiated in a sufficient tone volume from the back-loaded horn driven at the back surface of this speaker unit.

According to the fourth aspect, since the back-loaded horn is housed in the side plate portion by utilizing a size plate, design limitations can be minimized, and cost can be advantageously reduced. In some cases, the thickness of the side plate may be increased in relation to a storage volume of the back-loaded horn. An increase in thickness of the side plate is also advantageous in terms of design since it provides a good appearance as a high-grade system.

Since the speaker system of the present invention is of a horn-loaded type, it has a high conversion efficiency, and can output a bass sound in a sufficient tone volume. In addition, neither a high-power amplifier nor high-withstand input speaker are necessary. Thus, the speaker system of the present invention is also advantageous in this respect.

DETAILED DESCRIPTION OF THE PREFERRED EMBODIMENTS

Preferred embodiments of the present invention will be described below with reference to the accompanying drawings.

First Embodiment

Figure 1:
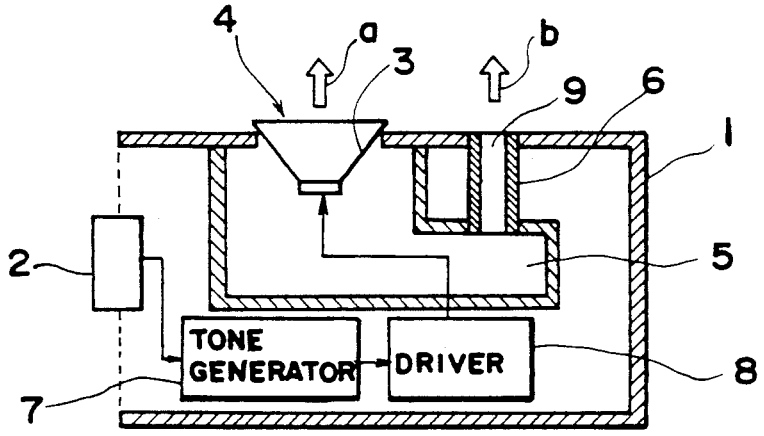
FIG. 1 is a schematic view showing a basic arrangement of a portable electrical musical instrument according to a first embodiment of the present invention.

FIG. 1 shows a basic arrangement of a portable electrical musical instrument according to a first embodiment of the present invention. In the electrical musical instrument shown in FIG. 1, the present invention is applied to a musical instrument in which a tone generating device 2 such as a membrane of a drum, a string of a guitar or the like, a reed, or the like is arranged on the left surface of an instrument housing 1 also serving as a resonator. A vibrator (dynamic speaker unit) 4 having a diaphragm 3 is mounted in a hole formed in the upper surface of the instrument housing 1. A closed cabinet (cavity) 5 having the upper surface of the instrument housing 1 as an upper surface is formed behind the vibrator 4. A duct 6 for causing the interior of the closed cabinet 5 to acoustically communicate with the outside the instrument housing 1 is provided in the upper surface of the instrument housing 1. The closed cabinet 5 and the duct 6 constitute a Helmholtz resonator. In addition, a tone generating circuit 7 such as a pickup for converting a mechanical or acoustic vibration of the tone generating device 2 into an electrical signal and a vibrator driver 8 for driving the vibrator 4 on the basis of the electrical signal supplied from the tone generating circuit 7 are arranged.

In the Helmholtz resonator, an air resonance phenomenon occurs by an air spring in the closed cabinet 5 as the closed cavity and an air mass in the duct 6. The resonance frequency $f_{op}$ is given by:

$$f_{op}=c(S_1/l_1V_1)^{178}/2\pi\ldots \quad (1)$$

where $V_1$ is the volume of the closed cabinet 5, $S_1$ is the sectional area of the duct 6, $l_1$ is the length of the duct 6, and c is the sonic speed.

The Helmholtz resonator and the vibrator 4 constitute a speaker system (to be referred to as a speaker system with a resonance port hereinafter) having a shape similar to a conventional phase-inversion (bass-reflex) type speaker system.

The vibrator driver 8 drives the vibrator 4 to cancel an air counteraction from the Helmholtz resonator, i.e., the closed cabinet (cavity) 5 side when the Helmholtz resonator is driven. The driver can employ a known circuit such as a negative impedance generator for equivalently generating a negative impedance component ($-Z_0$) in an output impedance, a motional feedback (MFB) circuit for detecting a motional signal corresponding to am movement of a vibrating body by a certain method and negatively feeding back the detected signal to an input side, or the like.

The operation of the portable electrical musical instrument shown in FIG. 1 will be described below.

When the tone generating device 2 is operated during a performance of the electrical musical instrument, the tone generating circuit 7 converts a mechanical or acoustic vibration in the tone generating device 2 into an electrical signal. The vibrator driver 8 drives the vibrator 4 on the basis of the electrical signal supplied from the tone generating circuit 7. Thus, the mechanical vibration of the tone generating device 2 is directly generated as a sound, and the sound is produced in a tone volume while being amplified through the speaker system with the resonance port constituted by the vibrator 4 and the Helmholtz resonator.

In this portable electrical musical instrument, since the instrument housing 1 serves as a resonance box, a sound can be produced in a tone volume large enough to tune the musical instrument or to confirm a performance content by a player himself while the tone generating circuit 7 and the vibrator driver 8 are turned off.

When the vibrator driver 8 supplies a drive signal to the vibrator 4, the vibrator 4 electro-mechanically converts this signal to reciprocate the diaphragm 3 in the back-and-forth direction (the vertical direction in FIG. 1). The diaphragm 3 mechano-electrically converts this reciprocal motion. In this case, the front surface side (upper surface side in FIG. 1) of the diaphragm 3 serves as a direct radiation portion for directly externally radiating an acoustic wave. The rear surface side (lower surface side in FIG. 1) of the diaphragm 3 serves as a resonator driving portion for driving the Helmholtz resonator constituted by the closed cabinet 5 and the duct 6. Although an air counteraction from air in the closed cabinet 5 is applied to the rear surface side of the diaphragm 3 upon operation of the diaphragm, the vibrator driver 8 drives the vibrator 4 to cancel this air counteraction.

In this manner, when the vibrator 4 is driven to cancel the air counteraction from the resonator when the Helmholtz resonator is driven, the diaphragm 3 cannot be driven by the resonator side, and serves as a rigid body, i.e., a wall viewed from the resonator. Therefore, the resonance frequency and Q value of the Helmholtz resonator are independent from those of the direct radiation portion constituted by the diaphragm 3 and the vibrator 4, and a resonator driver energy from the vibrator 4 is applied independently of that from the direct radiation portion. Since the vibrator 4 is driven in a so-called "dead" state wherein it is not influenced by the air counteraction from the resonator, i.e., the closed cabinet 5 side, the frequency characteristic of the directly radiated acoustic wave is not influenced by the volume of the closed cabinet 5. Therefore, according to the arrangement of this embodiment, when the volume of the closed cabinet 5 as the cavity of the Helmholtz resonator can be reduced to be smaller than that of a conventional portable electrical musical instrument such as an acoustic guitar, and at the same time, the resonance frequency $f_{op}$ is set to be lower than that of the conventional instrument, a sufficient Q value can be assured. As a result, if the closed cabinet 5 is considerably reduced in size as compared to a conventional portable electrical musical instrument, reproduction to a lower bass sound can be performed.

Figure 2:
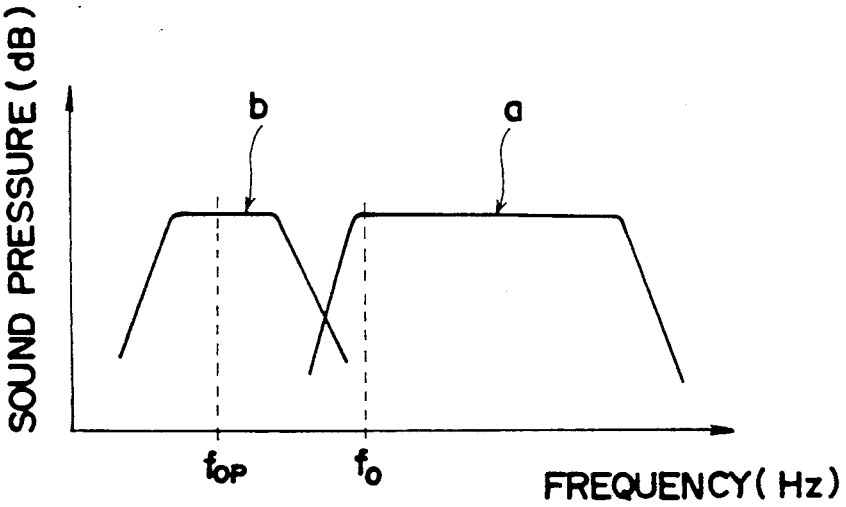
FIG. 2 is a graph for explaining output sound pressure-frequency characteristics of an acoustic apparatus of the musical instrument shown in FIG. 1.

In FIG. 1, the vibrator 4 drives the diaphragm 3 in response to the drive signal from the vibrator driver 8, and independently supplies a drive energy to the Helmholtz resonator constituted by the closed cabinet 5 and duct 6. Thus, an acoustic wave is directly radiated from the diaphragm 3, as indicated by an arrow a in FIG. 1, and air in the closed cabinet 5 is resonated, thus resonantly radiating an acoustic wave with a sufficient sound pressure from a resonant radiation portion (an opening port 9 of the duct 6), as indicated by an arrow b in FIG. 1. A frequency characteristic of a sound pressure, as shown in, e.g., FIG. 2, can be obtained under conditions that the resonance frequency $f_{op}$ can be set to be lower than a reproduction frequency band of the vibrator 4 by adjusting an air equivalent mass in the duct in the Helmholtz resonator and a sound pressure with an appropriate level can be obtained from the duct 6 by setting the Q value at an appropriate level upon adjustment of the equivalent resistance of the duct 6. In FIG. 2, a curve a represents a frequency characteristic of a sound pressure of an acoustic wave directly radiated from the vibrator 4, and a curve b represents a frequency characteristic of a sound pressure of an acoustic wave resonantly radiated from the opening port 9.

Figure 3A:
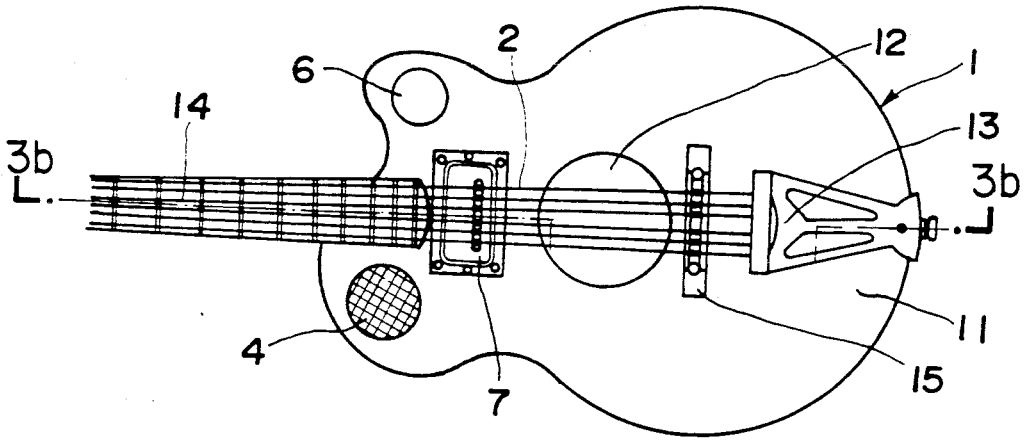
FIGS. 3(*a*) and 3(*b*) are views showing a detailed arrangement of an application of the portable electrical musical instrument shown in FIG. 1, in which FIG. 3(*a*) is a front view and, FIG. 3(*b*) is a sectional view taken along a line 3*b*—3*b* in FIG. 3(*a*)
Figure 3B:
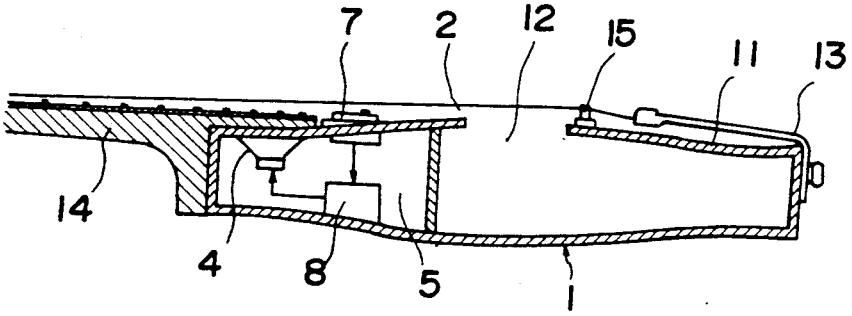

FIGS. 3(*a*) and 3(*b*) show a detailed arrangement of the portable electrical musical instrument shown in FIG. 1. In the electrical musical instrument shown in FIGS. 3(*a*) and 3(*b*), a small-diameter speaker unit is used in a so-called semi-acoustic guitar whose thickness is smaller than that of a conventional acoustic guitar. In the portable electrical musical instrument, the interior of a guitar body (instrument housing) 1 is partially partitioned to form a closed cabinet 5. A speaker unit (vibrator) 4 is mounted in a hole formed in a portion of a top plate 11 of the body 1, which serves as one surface of the closed cabinet 5. A duct 6 which forms a Helmholtz resonator together with the closed cabinet 5 is arranged in the top plate 11. In addition, a pickup (tone generating circuit) 7 for converting a vibration of each guitar string (tone generating device) 2 into an electrical signal and a negative impedance generator (vibrator driver) 8 for driving the speaker unit 4 are arranged.

In FIGS. 3(*a*) and 3(*b*), reference numeral 12 denotes a sound hole; 13, a tail piece; 14, a neck; and 15, a bridge.

In this manner, a portion of the body 1 of the conventional semi-acoustic guitar is used as the resonator of the speaker system with the resonance port, and the speaker system is driven by a negative impedance, so that a frequency characteristic with an expanded bass sound characteristic can be obtained regardless of the characteristic of the speaker unit 4.

Second Embodiment

Figure 4:
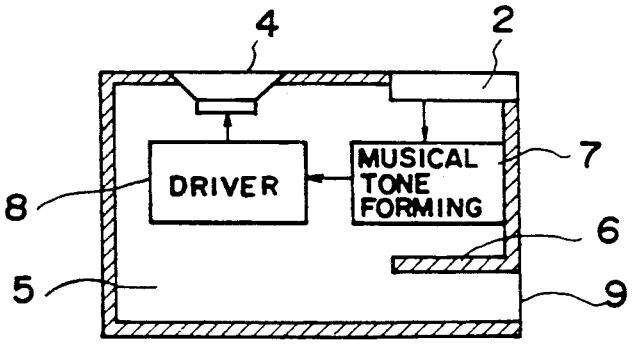
FIG. 4 is a schematic view showing a basic arrangement of a portable electronic musical instrument according to a second embodiment of the present invention.

FIG. 4 shows a basic arrangement of a portable electronic musical instrument according to a second embodiment of the present invention. In the electronic musical instrument shown in FIG. 4, the entire interior of an instrument housing 1 is also used as a closed cabinet 5. A tone generation instruction means 2 such as a keyboard, drum pad, breath input device, or the like, and a musical tone forming means 7 for electrically forming a musical tone instructed by the tone generation instruction means 2 are arranged in place of a tone generation controller consisting of the tone generating device 2 and the tone generating circuit 7 shown in FIG. 1. Other arrangements are the same as those in FIG. 1.

Therefore, the electronic musical instrument of this embodiment is operated in the same manner as the musical instrument shown in FIG. 1, except that a musical tone signal during a performance is formed by an electrical circuit such as a memory, oscillator, and the like, and no musical tone can be generated while a power switch is OFF since a sound source does not directly generate a mechanical or acoustic vibration and the instrument housing does not resonate with the directly generated vibration.

The second embodiment can be applied to portable electronic musical instruments such as a portable electronic keyboard, electronic percussion, electronic wind instrument, and the like. According to this embodiment, a bass sound characteristic can be improved by utilizing a relatively small space in these portable electronic musical instruments.

The operation of the acoustic apparatus wherein a speaker system utilizing a Helmholtz resonator is driven by a negative impedance generator will be described below.

Figure 5:
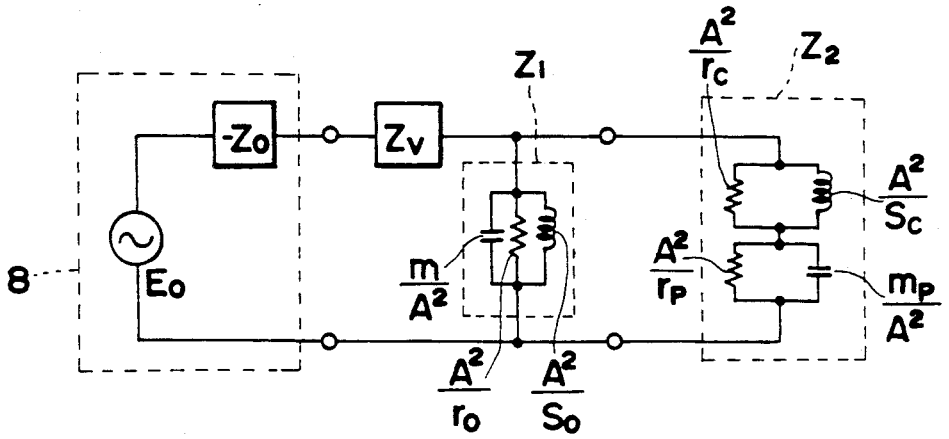
FIG. 5 is an electrically equivalent circuit diagram of an acoustic apparatus portion of the musical instrument shown in FIGS. 1 and 4.

FIG. 5 shows an arrangement of an electric equivalent circuit of the portion comprising a negative impedance driver as the vibrator driver 8, and the speaker system with resonance port constituted by the vibrator 4, the closed cabinet 5 and duct 6 each shown in FIG. 1 and FIG. 4. In FIG. 5, reference symbol $E_0$ denotes a voltage source as a drive signal source. A parallel resonance circuit $Z_1$ is formed by the equivalent motional impedance of the vibrator 4. In this circuit, reference symbol $r_o$ denotes an equivalent resistance of the vibration system of the vibrator 4; $S_o$, an equivalent stiffness of the vibration system; and $m_o$, an equivalent mass of the vibration system. A series resonance circuit $Z_2$ is formed by an equivalent motional impedance of a Helmholtz resonator constituted by the duct 6 and the closed cabinet (cavity or hollow) 5. In this circuit, reference symbol $r_c$ denotes an equivalent resistance of the cavity 5; $S_c$, an equivalent stiffness of the cavity 5; $r_p$, an equivalent resistance of the duct 6; and $m_p$, an equivalent mass of the duct 6. In the Figure, reference symbol A denotes a force coefficient. When the vibrator 4 is a dynamic direct radiation speaker unit, $A=Bl_v$ where B is the magnetic flux density in a magnetic gap, and $l_v$ is the total length of a voice coil conductor. In the Figure, reference symbol $Z_V$ denotes an internal impedance (non-motional impedance) of the vibrator 4. When the vibrator 4 is a dynamic direct radiation speaker unit, the impedance $Z_V$ mainly comprises a resistance $R_V$ of the voice coil, and includes a small inductance.

Figure 6:
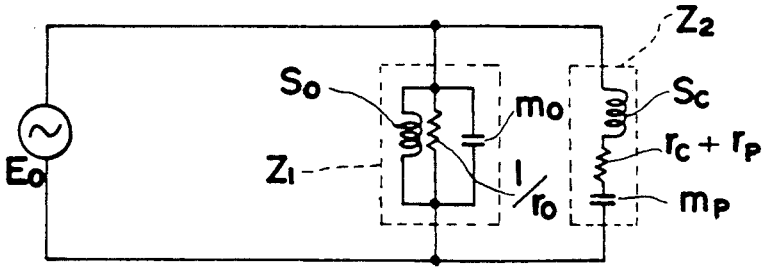
FIG. 6, is an equivalent circuit diagram when $Z_V - Z_0 = 0$ in FIG. 5.

FIG. 6 shows an electrically equivalent circuit when $Z_V-Z_0=0$ in FIG. 5, i.e., when the internal impedance (non-motional impedance) of a vibrator 4 is equivalently completely invalidated. In FIG. 6, coefficients suffixed to values of respective components are omitted.

The equivalent circuit diagram reveals the following facts.

The two ends of the parallel resonance circuit $Z_1$ formed by the equivalent motional impedance of the vibrator 4 are short-circuited at a zero impedance in an AC manner. Therefore, the parallel resonance circuit $Z_1$ has a Q value of 0, and can no longer serve as a resonance circuit. More specifically, this vibrator 4 loses the concept of a lowest resonance frequency which is present in a state wherein the vibrator 4 is merely mounted on the Helmholtz resonator. In the following description, the lowest resonance frequency $f_0$ or equivalent of the vibrator 4 merely means the essentially invalidated concept. In this manner, since the unit vibration system (parallel resonance circuit) $Z_1$ does not essentially serve as a resonance circuit, the resonance system in this acoustic apparatus is only the Helmholtz resonance system (series resonance circuit) $Z_2$.

Since the vibrator 4 does not essentially serve as the resonance circuit, it linearly responds to a drive signal input in real time, and faithfully electro-mechanically converts an electrical input signal (drive signal $E_0$) without transient response, thus displacing the diaphragm 3. That is, a perfect damped state (so-called "speaker dead" state) is achieved. The output sound pressure-frequency characteristics around the lowest resonance frequency $f_0$ or equivalent of this speaker in this state are 6 dB/oct. Contrary to this, characteristics of a normal voltage drive state are 12 dB/oct.

The series resonance circuit $Z_2$ formed by the equivalent motional impedance of the Helmholtz resonator is connected to the drive signal source $E_0$ at a zero impedance. Thus, the circuit $Z_2$ no longer has a mutual dependency with the parallel resonance circuit $Z_1$. Thus, the parallel resonance circuit $Z_1$ and the series resonance circuit $Z_2$ are present independently of each other. Therefore, the volume (in inverse proportion to $S_c$) of the closed cabinet 5, and the shape and dimension (in proportion to $m_p$) of the duct 6 do not adversely influence the direct radiation characteristics of the vibrator 4. The resonance frequency $f_{op}$ and the Q value $Q_{op}$ of the Helmholtz resonator are not influenced by the equivalent motional impedance of the vibrator 4. More specifically, the characteristic values ($f_{op}$, $Q_{op}$) of the Helmholtz resonator and the characteristic values ($f_o$, $Q_o$) of the vibrator 4 can be independently set. Furthermore, the series resistance of the series resonance circuit $Z_2$ is only $r_c+r_p$, and normally, these resistances are sufficiently small values. Thus, the Q value of the series resonance circuit $Z_2$, i.e., the Helmholtz resonator can be set to be sufficiently high.

From another point of view, since the unit vibration system does not essentially serve as a resonance system, the diaphragm 3 of the vibrator 4 is displaced according to a drive signal input $E_0$, and is not influenced by an external force, in particular, an air counteraction caused by the equivalent stiffness $S_c$ of the closed cabinet 5. For this reason, the diaphragm 3 of the vibrator 4 equivalently serves as a wall when viewed form closed cabinet 5 side, and the presence of the vibrator 4 when viewed from the Helmholtz resonator is invalidated. Therefore, the resonance frequency and the Q value of the Helmholtz resonator do not depend on the non-motional impedance inherent of the vibrator 4. Then, even when the resonance frequency is set to be a value so that the Q value is considerably decreased in a conventional drive method, the Q value can be maintained to be a sufficiently large value. The Helmholtz resonance system is present as a virtual speaker which performs acoustic radiation quite independently of the unit vibration system. Although the virtual speaker is realized by a small diameter corresponding to the port diameter, it corresponds to one having a considerably large diameter as an actual speaker in view of its bass sound reproduction power.

The system and apparatus of the present invention described above will be compared with a conventional system wherein a bass-reflex type speaker system or a speaker system with a resonator is driven by an ordinary power amplifier. In the conventional system, as is well known, a plurality of resonance systems, i.e., the unit vibration system $Z_1$ and the Helmholtz resonance system $Z_2$, are present, and the resonance frequencies and the Q values of the resonance systems closely depend on each other. For example, if the duct 6 is elongated or its diameter is reduced ($m_p$ is increased) to decrease the resonance frequency of the Helmholtz resonance system $Z_2$, the Q value of the unit vibration system $Z_1$ is increased and the Q value of the Helmholtz resonance system $Z_2$ is decreased. If the volume of the closed cabinet 5 is decreased ($S_c$ is increased), the Q value and the resonance frequency of the unit vibration system $Z_1$ are increased, and the Q value of the Helmholtz resonance system $Z_2$ is further decreased even if the resonance frequency of the Helmholtz resonance system $Z_2$ is kept constant by elongating the port or decreasing its diameter. More specifically, since the output sound pressure-frequency characteristics of the speaker system are closely related to the characteristics of the speaker unit 4, the volume of the cavity 5 and the dimensions of the duct 6, a high-grade design technique is required to match them. Even if perfect matching is attained, a bass range limit of uniform reproduction is at most about $1/\sqrt{3}$ of the resonance frequency $f_{oc}$ in a state wherein the speaker unit 4 is mounted in the cavity 5. Once matching is attained, it is generally not considered that a cavity 5 can be made compact in size without impairing the frequency characteristics of an output sound pressure, in particular, bass range characteristics, and that an acoustic reproduction range can easily be expanded by an existing speaker system driven by any conventional driving system without impairing a sound quality. The relationship between the frequency lower than the resonance frequency and a resonance acoustic radiation power in the Helmholtz resonance system $Z_2$ is decreased at a rate of 12 dB/oct with respect to a decrease in frequency when viewed from the sound pressure level. Thus, when the resonance frequency is set to be extremely lower than that of the basic concept of the bass-reflex speaker system, compensation by increasing/decreasing an input signal level is very difficult to achieve.

In the apparatus of the first embodiment, as described above, since the speaker system utilizing Helmholtz resonance is driven by a negative impedance, the characteristics, dimensions, and the like of the unit vibration system and the Helmholtz resonance system can be independently set. In addition, even if the resonance frequency of the Helmholtz resonance system is set to be low, the large Q value and the high bass sound reproduction power can be maintained, and the resonator drive power of the unit vibration system can be increased (6 dB/oct). Therefore, nonuniformity of the frequency characteristics can be advantageously compensated by increasing/decreasing an input signal level like in normal sound quality control. Since the unit vibration system essentially does not serve as the resonance system, an abrupt phase shift near the frequency $f_{oc}$ does not occur, and hence, a good phase characteristic can be provided. For this reason, a cavity 5 can be rendered compact and speaker system can be made compact in size without impairing frequency characteristics and a sound quality. In addition, the sound quality can be improved or the acoustic reproduction range, in particular, a bass sound range, can be easily expanded by driving an existing speaker system, as compared with the case wherein the speaker system is driven by a conventional constant-voltage driving system.

In the above description, the case of $Z_V - Z_0 = 0$ has been exemplified. However, the present invention includes a case of $Z_V - Z_0 > 0$ if $-Z_0 < 0$. In this case, the characteristic values and the like of the unit vibration system and the Helmholtz resonance system become intermediate values between the case of $Z_{V-Z0} = 0$ and the case of the conventional constant voltage drive system. Therefore, by positively utilizing this nature, the Q value of the Helmholtz resonance system can be adjusted by adjusting the negative impedance $-Z_0$ instead of adjusting the port diameter of the duct 6 or inserting a mechanical Q damper such as glass wool or felt in the cavity 5.

Figure 7:
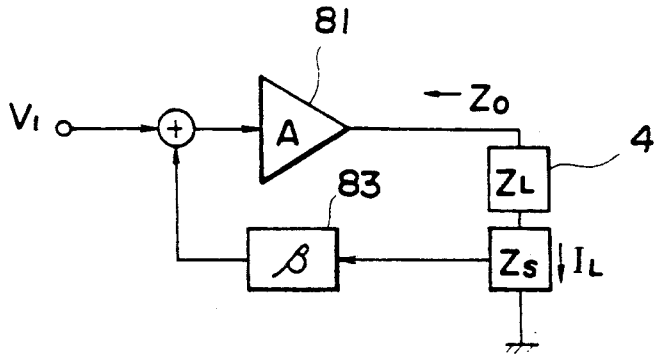
FIG. 7 is a basic circuit diagram of a circuit for generating a negative impedance.

FIG. 7 shows the basic arrangement of a negative impedance generator for driving a vibrator (speaker unit) 4 by negative impedance.

In the circuit shown in the Figure, an output from an amplifier 81 having a gain A is supplied to a load $Z_L$ constituted by a vibrator 4. A current $I_L$ flowing through the load $Z_L$ is detected, and the detected current is positively fed back to the amplifier 81 through a feedback circuit 83 having a transmission gain $\beta$. Thus, the output impedance $Z_0$ of the circuit is given by:

$$Z_0 = Z_S(1 - A\beta) \ldots \quad (2)$$

From equation (2), if $A\beta > 1$, $Z_0$ is an open stable type negative impedance. In the equation, $Z_S$ is the impedance of a sensor for detecting the current.

Therefore, in the circuit shown in FIG. 7, the type of impedance $Z_S$ is appropriately selected, so that the output impedance can include a desired negative impedance component. For example, when the current $I_L$ is detected by a voltage across the two ends of the impedance $Z_S$, if the impedance $Z_S$ is a resistance $R_S$, the negative impedance component is a negative resistance component; if the impedance $Z_S$ is an inductance $L_S$, the negative impedance component is a negative inductance component; and if the impedance $Z_S$ is a capacitance $C_S$, the negative impedance component is a negative capacitance component. An integrator is used as the feedback circuit 83, and a voltage across the two ends of the inductance $L_S$ as the impedance $Z_S$ is detected by integration, so that the negative impedance component can be a negative resistance component. A differentiator is used as the feedback circuit 83, and a voltage across the two ends of the capacitance $C_S$ as the impedance $Z_S$ is detected by differentiation, so that the negative impedance component can be a negative resistance component. As the current detection sensor, a current probe such as a C.T. (current transformer) or a Hall Element can be used in place of, or in addition to these impedance elements $R_S$, $L_S$ and $C_S$.

An embodiment of the above-mentioned circuit is described in, e.g., Japanese Patent Publication No. Sho 59-51771.

Figure 8:
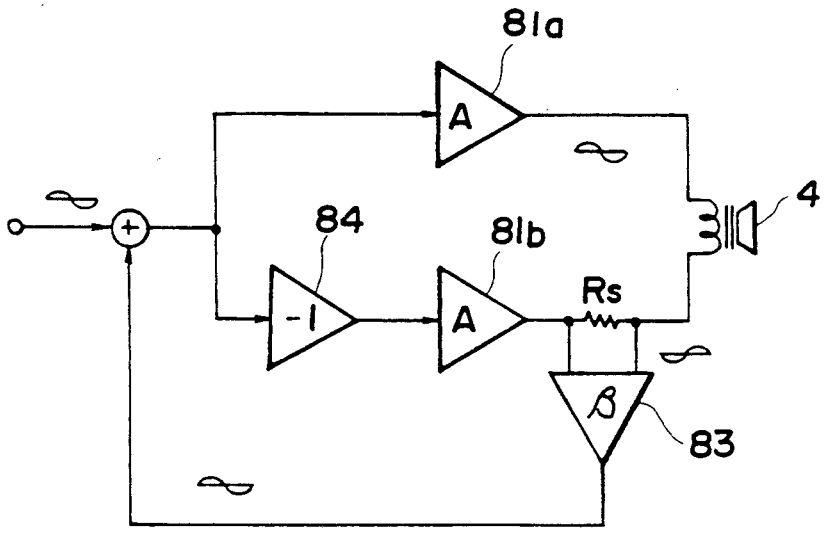
FIG. 8 is a circuit diagram showing a modification of the circuit shown in FIG. 7.

Current detection can be performed at a nonground side of the vibrator 4. An embodiment of such a circuit is described in, e.g., Japanese Patent Publication No. Sho 54-33704. FIG. 8 shows a BTL connection. This can be easily applied to the circuit shown in FIG. 7. In FIG. 8, reference numeral 84 denotes an inverter.

Figure 9:
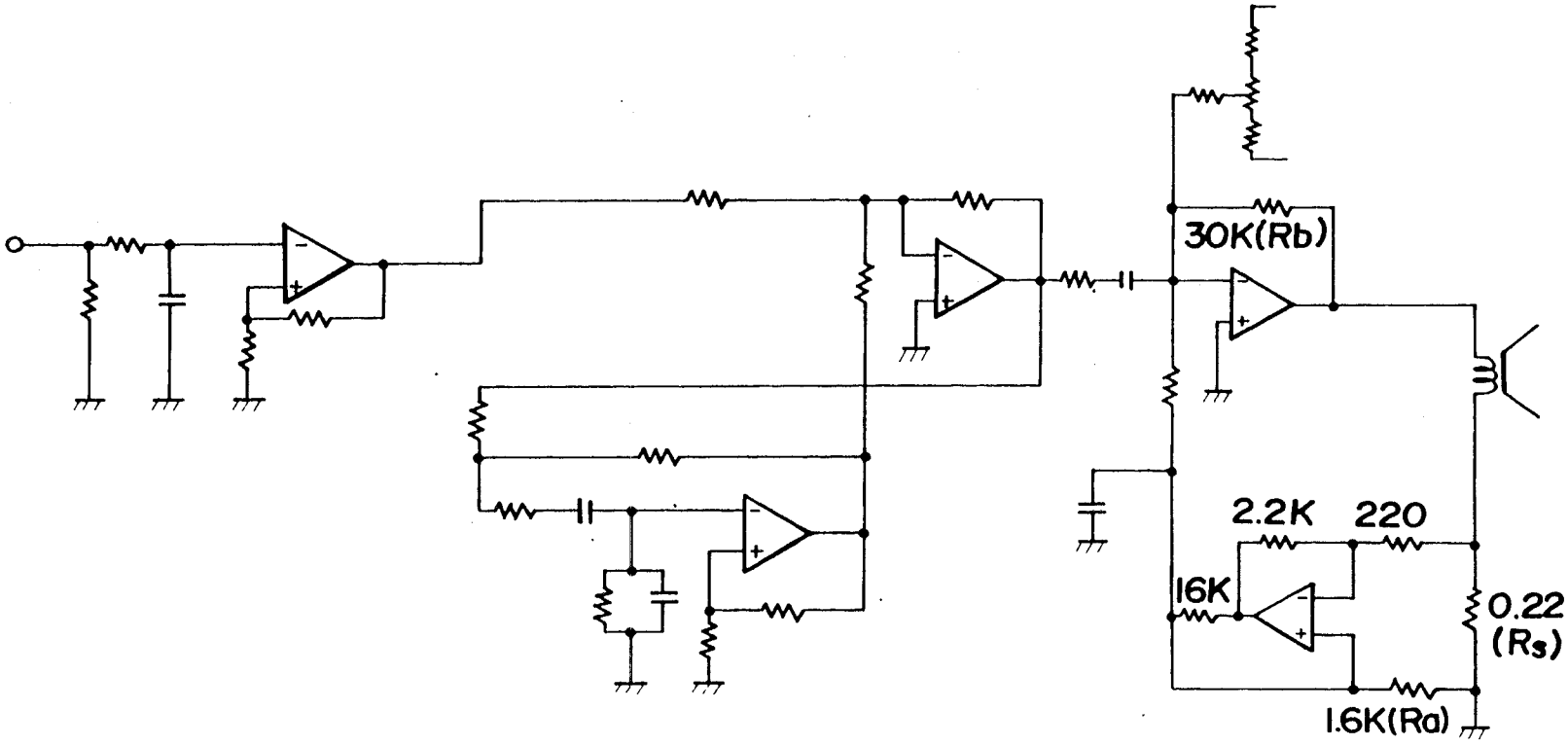
FIG. 9 is a circuit diagram showing a detailed arrangement of the circuit shown in FIG. 7.

FIG. 9 shows a detailed circuit of amplifiers which include a negative resistance component in its output impedance.

The output impedance $Z_0$ in the amplifier shown in FIG. 8 is given by:

$$\begin{aligned} Z_0 &= R_S(1 - R_b/R_a) \\ &= 0.22(1 - 30/1.6) \\ &= -3.9\ (\Omega) \end{aligned}$$

Third Embodiment

Figure 10:
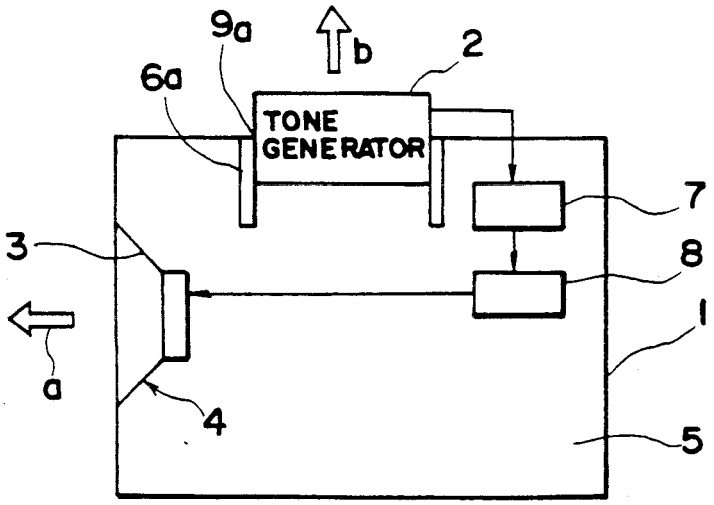
FIG. 10 is a schematic view showing a basic arrangement of a portable electrical musical instrument according to a third embodiment of the present invention.

FIG. 10 shows a basic arrangement of a portable electrical musical instrument according to a third embodiment of the present invention. In the musical instrument shown in FIG. 10, a duct 6a having an opening port 9a is formed in the upper surface of an instrument housing 1, so that a cavity 5 in the instrument housing 1 and the duct 6a constitute a Helmholtz resonator. A tone generating device 2 such as a membrane of a drum, a string of a guitar or the like, a reed, or the like, for driving the Helmholtz resonator is disposed near the opening port 9a. A hole is formed in the left surface of the instrument housing 1, and a vibrator (dynamic speaker unit) 4 having a diaphragm 3 is mounted in this hole. In addition, a tone generating circuit 7 such as a pickup for converting a mechanical or acoustic vibration of the tone generating device 2 into an electrical signal and a vibrator driver 8 for driving the vibrator 4 based on the electrical signal supplied from the tone generating circuit 7 are arranged.

The electrical musical instrument shown in FIG. 10 has substantially the same arrangement as that in FIG. 1, except that the musical instrument shown in FIG. 1 has an exclusive resonator for the acoustic apparatus while the musical instrument of this embodiment uses a resonator of a conventional musical instrument as a Helmholtz resonator for an acoustic apparatus.

The operation of the portable electrical musical instrument shown in FIG. 10 will be described below.

When the tone generating device 2 is operated during a performance of the musical instrument, the tone generating device 2 generates a mechanical vibration. The mechanical vibration operates the Helmholtz resonator through the opening port 9a, and is converted to an electrical signal by the tone generating circuit 7. The vibrator driver 8 drives the vibrator 4 on the basis of the electrical signal supplied from the tone generating circuit 7. Thus, the Helmholtz resonator directly produces a resonant sound corresponding to the mechanical vibration of the tone generating device 2, and a musical tone in a tone volume amplified through the speaker system with the resonance port constituted by the vibrator 4 and the Helmholtz resonator is produced.

Note that the Helmholtz resonator can produce a sound in a tone volume large enough to tune the musical instrument or to confirm a performance content by a player himself by the resonant cavity 5 of the musical instrument itself while the tone generating circuit 7 and the vibrator driver 8 are turned off.

The operation of the vibrator driver 8, the vibrator 4, and the Helmholtz resonator are the same as those in FIG. 1.

A conventional musical instrument is slightly modified such that the vibrator is attached to the resonator of a conventional musical instrument having the resonator in its main body, and is driven to cancel an air counteraction from the resonator side. In this manner, the conventional musical instrument main body can generate a heavy bass tone in a large tone volume.

Figure 11:
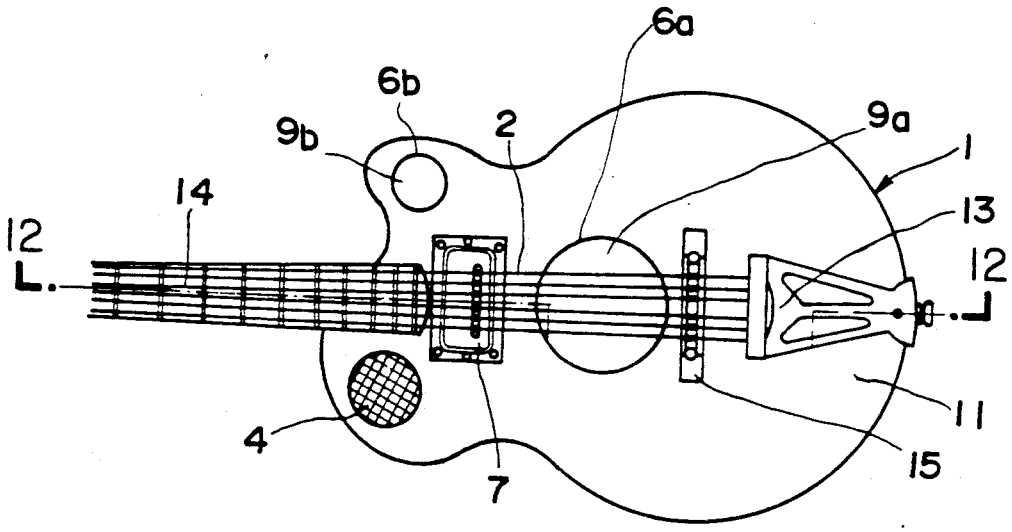
FIG. 11 is a front view showing a detailed application of the portable electrical musical instrument shown in FIG. 10.
Figure 12:
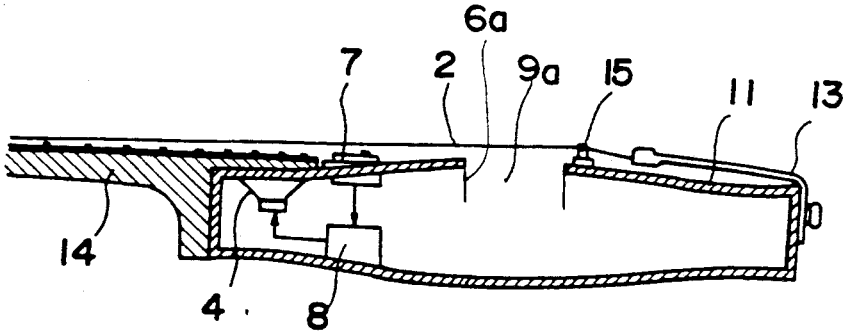
FIG. 12 is a sectional view of the portable electrical musical instrument shown in FIG. 11 taken along the line II—II in FIG. 11.

FIG. 11 shows a detailed arrangement of the portable electrical musical instrument shown in FIG. 10. FIG. 12 is a sectional view of the electrical musical instrument taken along the line II—II in FIG. 11. In this electrical musical instrument, a small-diameter speaker unit is used in a so-called semi-acoustic guitar whose thickness is reduced to be smaller than that of a conventional acoustic guitar. A second duct 6*b* having a second opening port 9*b* is provided to a top plate 11 of a guitar body (instrument housing) 1 provided with a first duct 6*a* having a first opening port (sound hole) 9*a*. A hole is formed in the top plate 11, and a speaker unit (vibrator) 4 is mounted in this hole. Furthermore, a pickup (tone generating circuit) 7 for converting a vibration of each guitar string (tone generating device) 2 into an electrical signal and a negative impedance generator (vibrator driver) 8 for driving the speaker unit 4 are arranged. In FIG. 11, reference numeral 13 denotes a tail piece; 14, a neck; and 15, a bridge. This musical instrument is arranged and operated in substantially the same manner as the musical instrument shown in FIGS. 3(*a*) and 3(*b*) except that the equivalent resistance $r_p$ and the equivalent mass $m_p$ shown in FIG. 5 are obtained by synthesizing those of the ducts 6*a* and 6*b* since the ducts 6*a* and 6*b* are provided in place of the duct 6 of the musical instrument shown in FIGS. 3(*a*) and 3(*b*).

In this manner, the body 1 of the conventional semi-acoustic guitar is used as the resonator of the speaker system, and this speaker system is driven at a negative impedance, so that a frequency characteristic with an expanded bass sound characteristic can be obtained regardless of the characteristic of the speaker unit 4.

In the portable electrical musical instrument shown in FIGS. 11 and 12, the second opening port 9*b* and the second duct 6*b* are arranged to change and set a resonance frequency of a resonator as an original musical instrument to be an optimal value. When the characteristic of the acoustic apparatus can be satisfactorily compensated for by setting the characteristics of the vibrator driver 8, the second opening port 9*b* and the second duct 6*b* need not always be arranged. The first duct 6*a* may have a length corresponding to that of the opening port 9*a*, i.e., the length $l_1$ of the first duct 6*a* = (thickness of the top plate 11) like in the conventional guitar.

Fourth Embodiment

Figure 13:
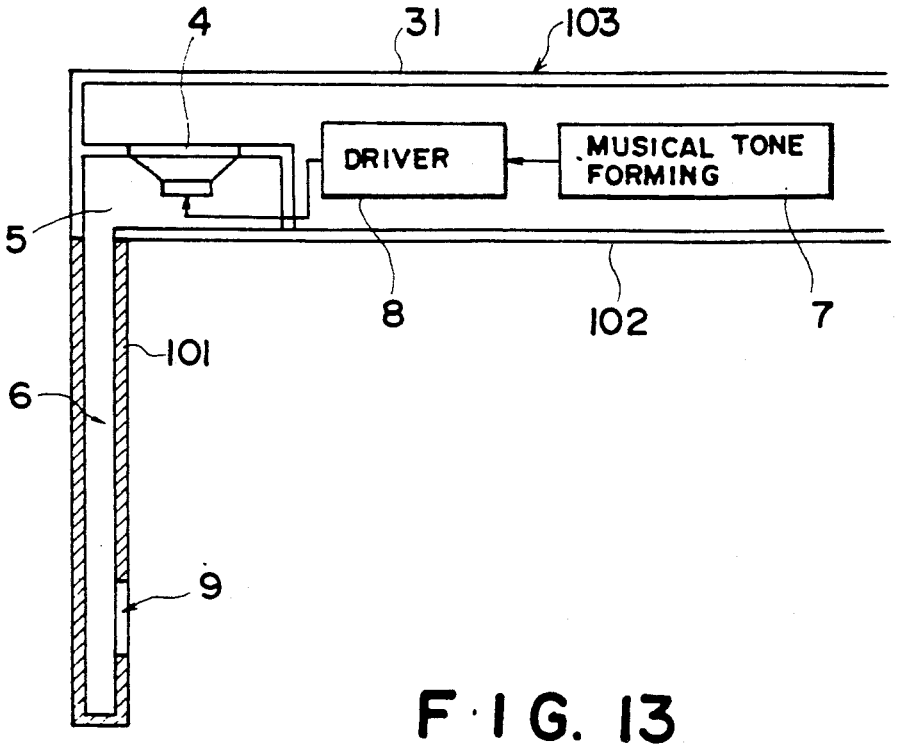
FIG. 13 is a schematic view of an electronic musical instrument according to a fourth embodiment of the present invention.

FIG. 13 shows an arrangement of an electronic musical instrument according to a fourth embodiment of the present invention. In this electronic musical instrument, a pair of upright side plates 101 (only one is shown) serve as leg portions of the musical instrument. The side plates 101 support a shelf plate 102 at a predetermined level. An electronic musical instrument main body 103 having a performance section such as a keyboard (not shown) is mounted on the shelf plate 102. A housing (speaker box) 5 provided with a vibrator (dynamic speaker unit) 4, a musical tone forming circuit (or means) 7 for forming a musical tone signal instructed by the performance section using an electronic circuit consisting of a memory, an oscillator, and the like, a vibrator driver 8 for driving the vibrator 4 based on the formed musical tone signal, and the like are disposed in the electronic musical instrument main body 103.

A duct 6 is formed in the housing 5 inside each side plate 101. One end of the duct 6 is open to the interior of the housing 5 and is acoustically coupled to the housing 5, and the other end is open to an external region of the musical instrument as an opening port 9. The housing 5 and the duct 6 constitute a Helmholtz resonator.

Figure 14A:
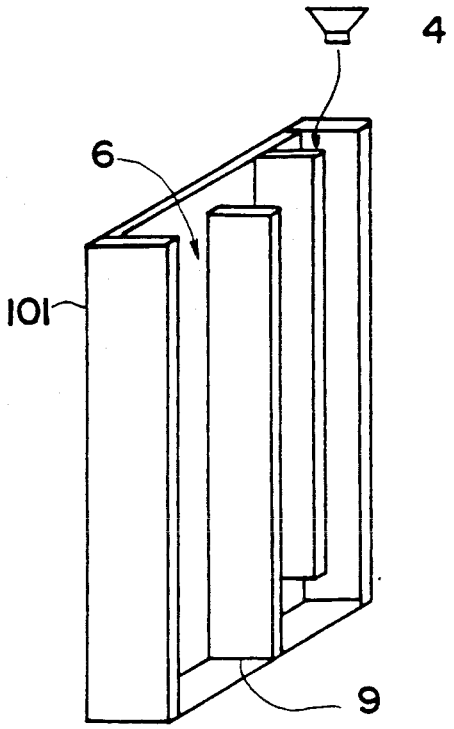
FIGS. 14(*a*) and 14(*b*) are perspective views showing a duct 6 in FIG. 13.
Figure 14B:
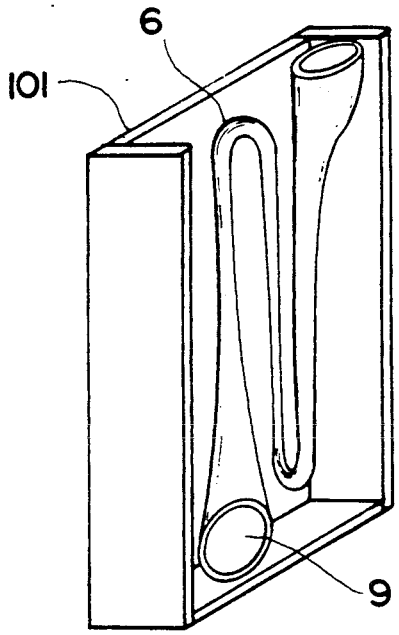

As the duct 6, the interior of each side plate 101 may be partitioned by walls to form an elongated zig-zag channel, as shown in FIG. 14(*a*), or a member having a shape similar to a horn section of a musical instrument such as a horn may be appropriately bent to be housed in each side plate 101, as shown in FIG. 14(*b*).

The operation of the portable electronic musical instrument shown in FIG. 13 will be described below.

When the performance section of the electronic musical instrument main body 103 is operated during a performance of this electronic musical instrument, the musical tone forming circuit 7 forms a musical tone signal on the basis of a tone generation instruction by the performance operation. The vibrator driver 8 drives the vibrator 4 on the basis of the musical tone signal supplied form the musical tone forming circuit 7.

The vibrator driver 8, the vibrator 4, and the Helmholtz resonator are operated in the same manner as has been described for the musical instrument shown in FIG. 1. As a result, as described above, the housing 5 can be made compact and a bass sound characteristic can be improved.

As described above, in the electronic musical instrument shown in FIG. 13, a heavy bass sound can be generated using a compact housing and a small-diameter vibrator. In other words, the housing can be made compact without impairing the bass sound characteristic or the bass sound characteristic can be improved without increasing the size of the housing. Since the housing can be made compact and the duct is formed in each side plate, design limitations can be eliminated, and an advantage in terms of cost can be provided. In some cases, when the duct is formed in each side plate of the electronic musical instrument, the thickness of the side plate may be increased as compared to a conventional one. However, an increase in thickness of the side plate advantageously leads to a high-grade appearance.

In the electronic musical instrument shown in FIG. 13, the vibrator 4 is arranged in the electronic musical instrument main body 103 so that sound quality is not so changed when a music score, an ornament, or the like is placed on a top plate 31. An opening is formed in, e.g., a front surface of the electronic musical instrument, so that a directly radiated sound is radiated therefrom. However, the vibrator 4 may be arranged to oppose the upper surface of the musical instrument. In this case, the top plate 31 can also be used as the upper surface of the housing 5, thus advantageously decreasing cost.

Fifth Embodiment

Figure 15:
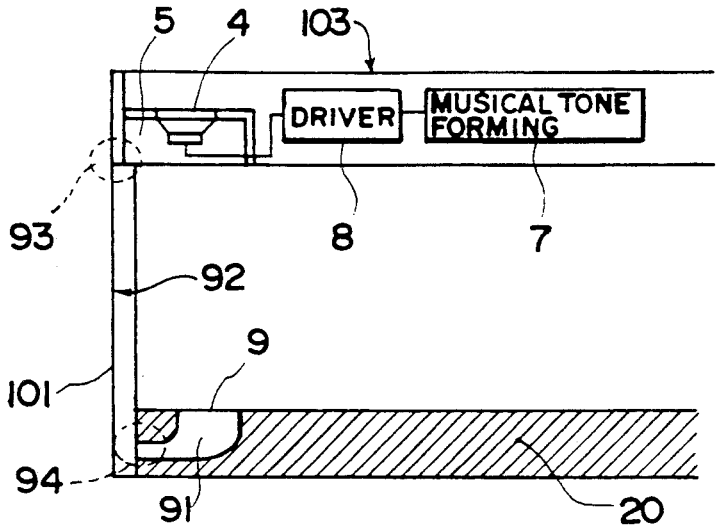
FIG. 15 is a schematic view showing an electronic musical instrument according to a fifth embodiment of the present invention.

FIG. 15 shows an embodiment wherein the present invention is applied to an electronic musical instrument having a bottom portion 20 constituting a pedal box or the like. In FIG. 15, an enlarged duct diameter portion 91 including an opening port 9 of a duct 6 is formed in the bottom portion 20 and a pipe portion 92 for causing the enlarged duct diameter portion 91 to communicate with the cavity in a housing 5 is formed in each side plate 101, separately. The housing 5 and the pipe portion 92, and the pipe portion 92 and the enlarged duct diameter portion 91 are respectively acoustically coupled. Note that acoustic coupling portions 93 and 94 for these members can be spatially coupled through corresponding openings, as shown in FIG. 13, or may be spatially separated using a passive vibrating body or the like.

The electronic musical instrument shown in FIG. 15 is operated in the same manner as that in FIG. 13. A bass sound characteristic can be improved without changing a design or the design can be simplified without impairing the bass sound characteristic. In particular, since a portion of the duct 6 is disposed in the bottom portion 20, the volume in the side plate 101 can be decreased, thus suppressing an increase in width or thickness of the side plate 101.

Figure 16A:
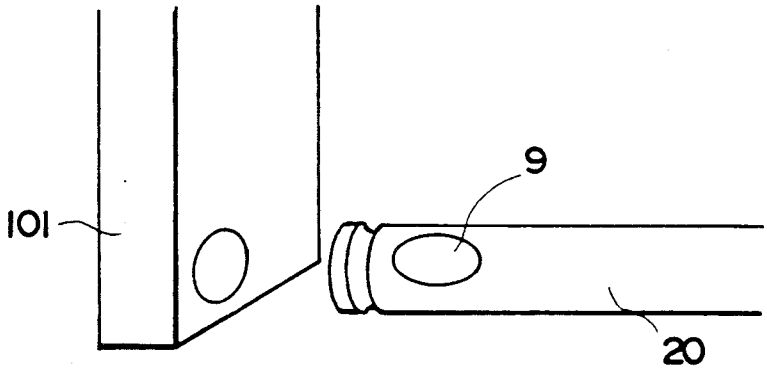
FIGS. 16(*a*) and 16(*b*) are enlarged views of an acoustic coupling portion 94 in FIG. 15.
Figure 16B:
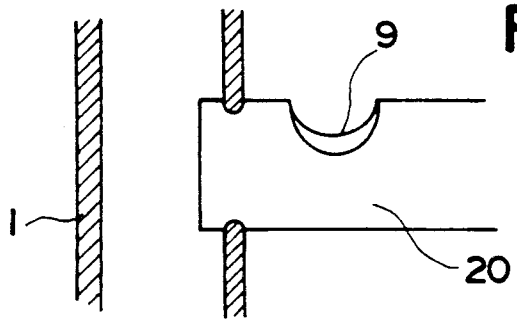

FIGS. 16(*a*) and 16(*b*) are partial enlarged views showing an arrangement of the acoustic coupling portion 94 in the electronic musical instrument shown in FIG. 15. When the pipe portion 92 and the enlarged duct diameter portion 91 are pivotally coupled, since the direction of the opening port (opening portion of the duct) 9 can be desirably set, it can be turned toward a player or audience to provide aural advantages. Of course, the acoustic coupling portion 94 may be fixed.

Sixth Embodiment

Figure 17:
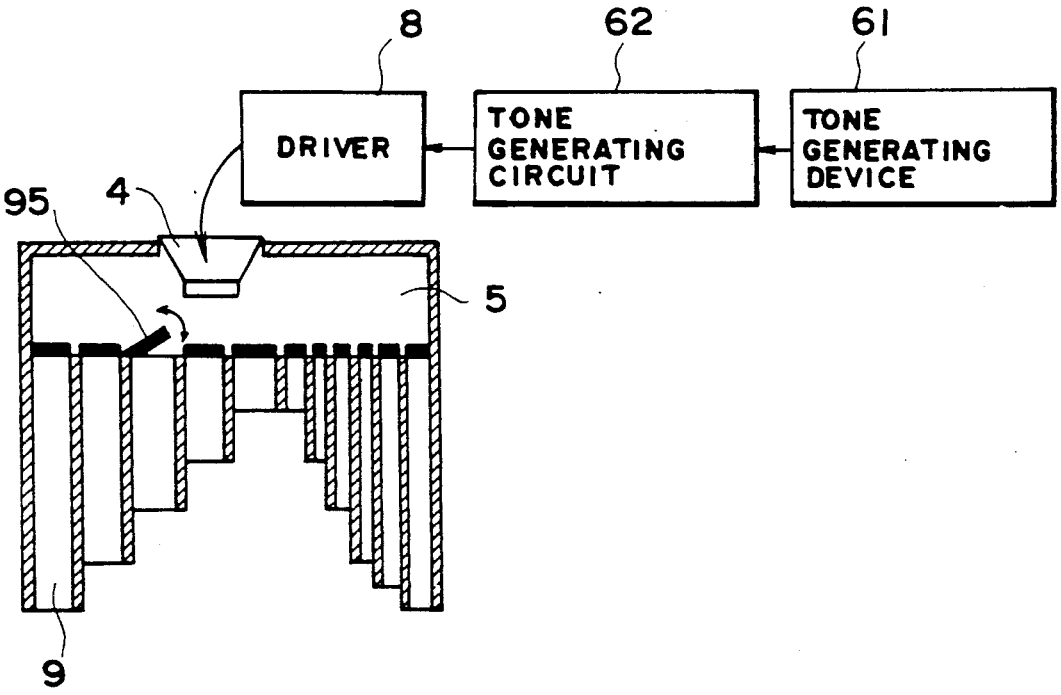
FIG. 17 is a schematic view of an electrical musical instrument according to a sixth embodiment of the present invention.

FIG. 17 shows an arrangement of a sixth embodiment of the present invention. In this embodiment, a plurality of pipes having different sectional areas S and lengths l are aligned as ducts 6, and a valve 95 is provided to a coupling portion between a speaker box 5 and each pipe. These pipes 6 are utilized as instrument stands. The valves 95 which are "opened" at the beginning of a performance are set in advance, so that sound quality or frequency characteristic can be matched with a music piece to be played or the favor of a player.

Figure 18:
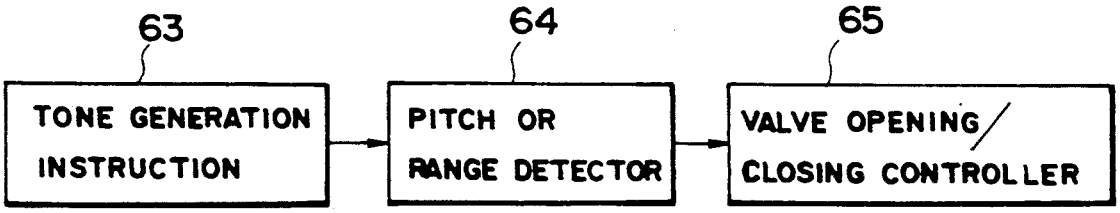
FIG. 18 is a block diagram showing a modification wherein a duct shown in FIG. 17 is applied to an electronic musical instrument.

FIG. 17 exemplifies an electrical circuit of an electrical musical instrument. When this embodiment is applied to an electronic musical instrument, a pitch (range) detecting means 64 and a valve opening/closing control means 65 are arranged, as shown in FIG. 18. A pitch or range of a musical tone to be generated is detected on the basis of an output from a tone generation instruction means (keyboard or the like) 63, and opening/closing control may be made based on the detection result so that the valve 95 of a duct which can constitute a resonator best suitable for the detected pitch or range is opened. In this case, when the tone generation instruction means (keyboard or the like) 63 instructs generation of musical tones of a plurality of pitches or a plurality of pitch ranges as musical tones to be generated, it is preferable in terms of improvement of a bass sound characteristic that the valve is opened/closed in correspondence with the lowest tone or range.

The electrical musical instrument shown in FIG. 17 has substantially the same arrangement as that shown in FIG. 13 except that a tone generating device 61 such as a membrane of a drum, a string of a guitar or the like, a reed, or the like, which vibrates by itself upon performance to generate a musical tone, and a tone generating circuit 62 such as a pickup for converting the mechanical or acoustic vibration of the tone generating device 61 into an electrical signal are arranged in place of a tone generation controller constituted by a tone generation instruction means such as a keyboard and a musical tone forming circuit 7 in the performance section of the electronic musical instrument shown in FIG. 13 or 15.

Therefore, the musical instrument of this embodiment is operated in the same manner as that shown in FIGS. 13 and 15, except that a musical tone signal upon performance is not electrically formed but is obtained by converting a mechanical or acoustic vibration into an electrical signal.

Seventh Embodiment

Figure 19:
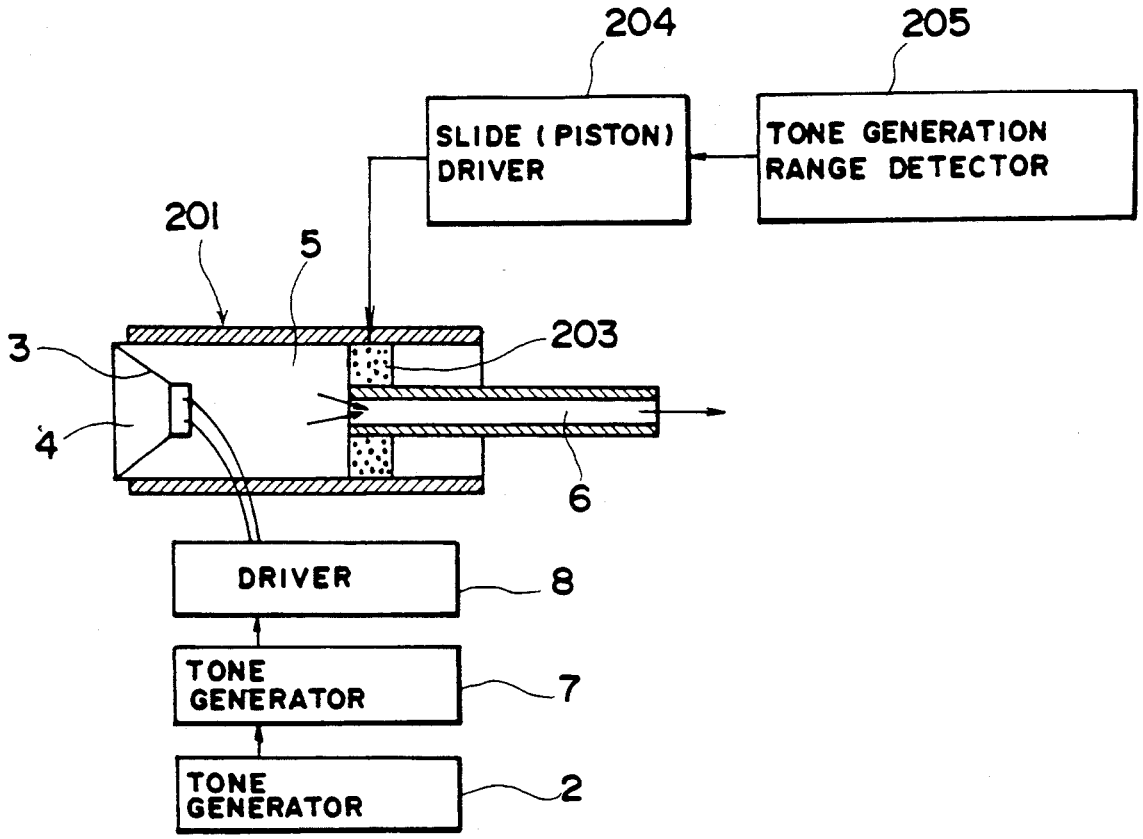
FIG. 19 is a schematic diagram of an electrical musical instrument according to a seventh embodiment of the present invention.

FIG. 19 shows an arrangement of an electrical musical instrument according to a seventh embodiment of the present invention.

The electrical musical instrument shown in FIG. 19 employs a cylinder whose one end is closed by a hollow piston 203 having a hollow portion (duct) 6 and whose other end is closed by a vibrator (dynamic speaker unit) 4 as a housing (speaker box) 201. This electrical musical instrument comprises a tone generating device 2 such as a membrane of a drum, a string of a guitar or the like, a reed, or the like, which mechanically or acoustically vibrates by itself upon performance to generate a musical tone, a tone generating circuit 7 such as a pickup for converting the mechanical or acoustic vibration of the tone generating device 2 into an electrical signal, a vibrator driver 8 for driving the vibrator 4 on the basis of the electrical signal supplied from the tone generating circuit 7, and the like.

In this electrical musical instrument, a cavity 5 in the housing 201 and the duct 6 of the piston 203 constitute a Helmholtz resonator. A resonance frequency $f_{op}$ of the Helmholtz resonator can be calculated from equation (1) as follows:

$$f_{op}=(S_1/l_1V_1)^{\frac{1}{2}}\cdot c/2\pi$$

The hollow piston 203 is movable in the cylinder 5 in the back-and-forth direction (right-and-left direction in FIG. 19). When this piston 203 is moved, the volume $V_1$ of the housing 201, i.e., the cavity 5 can be varied, and hence, the resonance frequency $f_{op}$ can be varied.

The operation principle of the musical instrument shown in FIG. 19 is the same as that of the musical instrument shown in FIG. 1.

Figure 20:
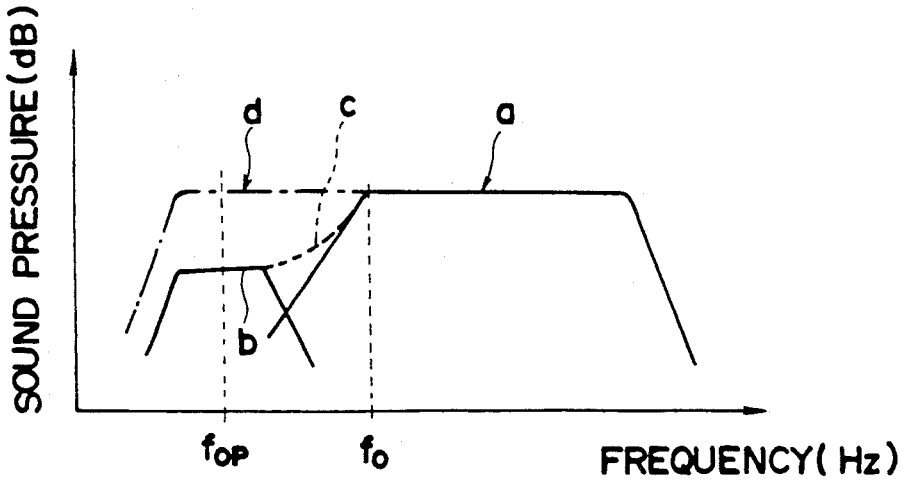
FIG. 20 is a graph for explaining output sound pressure-frequency characteristics of an acoustic apparatus of the musical instrument shown in FIG. 19.

FIG. 20 shows a frequency characteristic of an output sound pressure of the electrical musical instrument shown in FIG. 19. In FIG. 20, a curve a represents a frequency characteristic of a sound pressure of an acoustic wave directly radiated from the vibrator 4, and a curve b represents a frequency characteristic of a sound pressure of an acoustic wave resonantly radiated from the opening of the duct 6. A curve c obtained by synthesizing these frequency characteristic curves a and b corresponds to an output sound pressure characteristic of the speaker system constituted by the housing 201 (cavity 5), the duct 6, and the vibrator 4. A curve d which is corrected by increasing/decreasing an input signal level of the vibrator driver 8 is a total frequency characteristic of the electrical musical instrument shown in FIG. 19. The hollow piston 203 serves as a frequency characteristic variable control means. When the resonance frequency $f_{op}$ of the Helmholtz resonator is changed by sliding the hollow piston 203 in the right-and-left direction in FIG. 19 like a trombone, the lower limit of the frequency characteristic can be varied without adversely influencing the phase characteristic of the directly radiated acoustic wave. In this case, when the frequency characteristic drifts, the input signal level of the vibrator driver 8 is increased/decreased to perform correction, thus obtaining a flat overall frequency characteristic.

Eighth Embodiment

Figure 21:
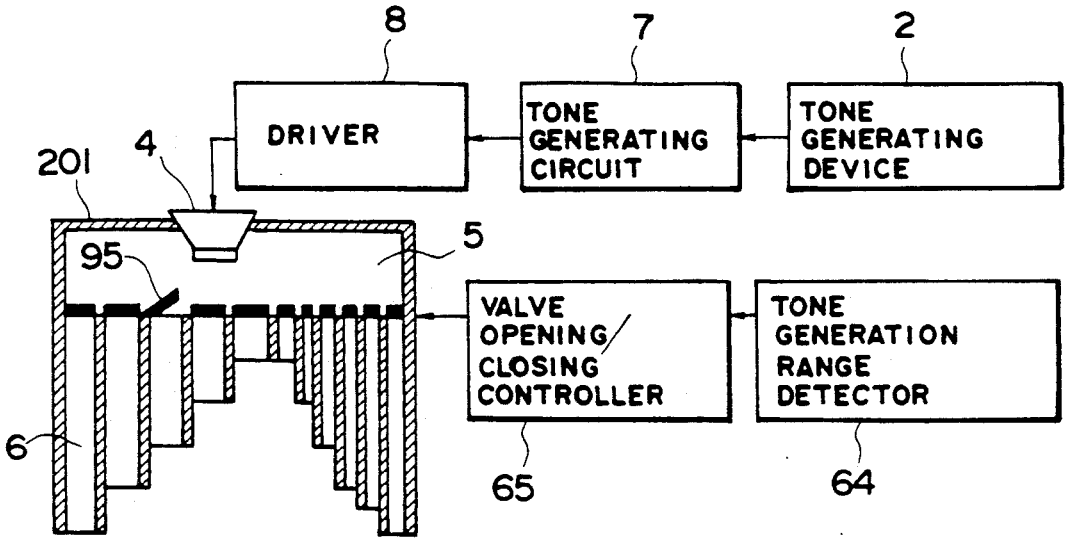
FIG. 21 is a schematic diagram of an electrical musical instrument according to an eighth embodiment of the present invention.

FIG. 21 shows an arrangement of an electrical musical instrument according to an eighth embodiment of the present invention. In this embodiment, a volume $V_1$ of a housing 201 is set to be constant, a plurality of pipes having different sectional areas S and lengths l are aligned as ducts 6, and a valve 95 is provided to a coupling portion between each pipe and the housing 201. In this embodiment, each valve 95 serves as a frequency characteristic variable control means. When these valves 95 are opened/closed to couple one, two or more ducts 6 to a cavity 5 of the housing 201, the resonance frequency $f_{op}$ of the Helmholtz resonator constituted by the ducts 6 and the cavity 5 can be varied. The player designates in advance the valves 95 which are "opened" at the beginning of a performance, so that sound quality or frequency characteristic can be matched with a music piece to be played or the favor of the player. The pipes 6 may be used as instrument stands or may be housed in side plates or a back plate of the musical instrument.

Ninth Embodiment

Figure 22:
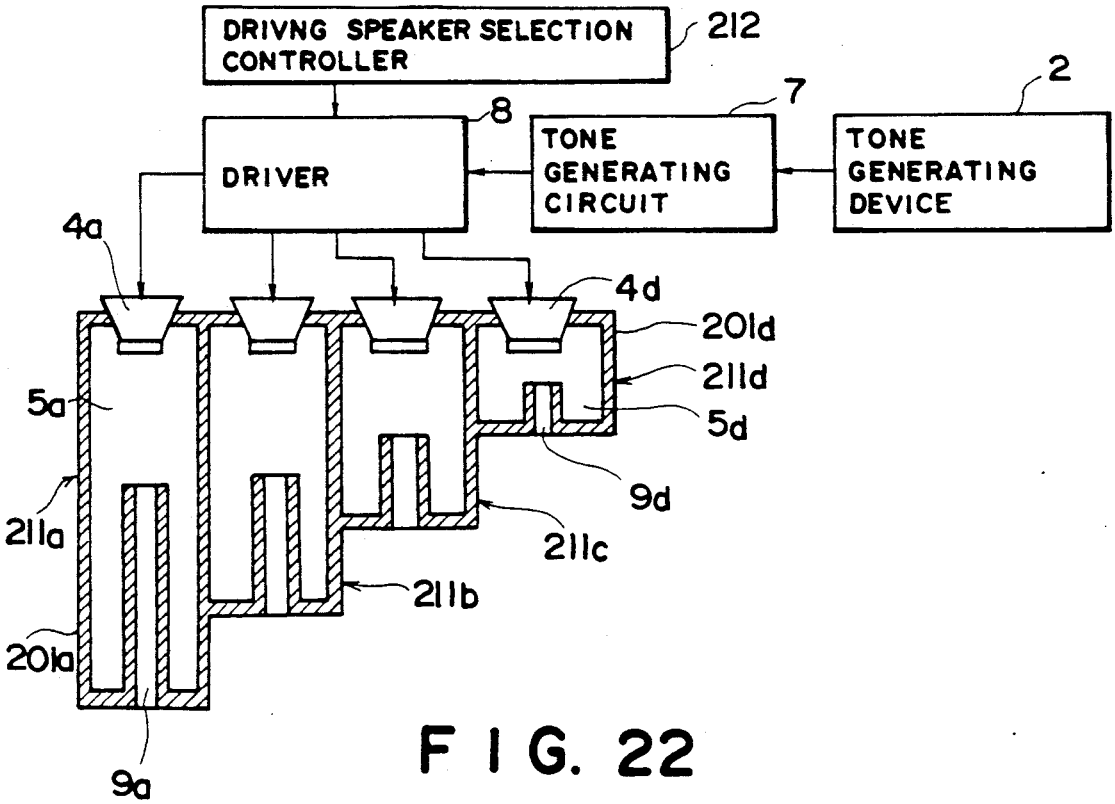
FIG. 22 is a schematic diagram of an electrical musical instrument according to a ninth embodiment of the present invention.

FIG. 22 shows a ninth embodiment of the present invention. In this embodiment, compact speaker units 4 (4*a* to 4*d*) are directly mounted in closed cabinets 201 (201*a* to 201*d*) each having a dual-pipe structure, respectively. Thus, a plurality of speaker systems 211 (211*a* to 211*d*) which have different volumes V and different sectional areas S and lengths l of ducts 6 and hence have different Helmholtz resonance frequencies $f_{op}$ are arrayed. In addition, a driving speaker selection controller 212 for selecting the speaker units 4 to be driven by a driver 8 in accordance with preset frequency characteristics is arranged.

In the electrical musical instrument shown in FIG. 22, the driving speaker selection controller 212 serves as a frequency characteristic variable control means. One, two or more speaker systems 211 are selected and are driven by the driver 8, so that sound quality or frequency characteristic can be matched with a music piece to be played or the favor of the player.

In the embodiments shown in FIGS. 19, 21, and 22, a pitch (range) detection means for detecting a performance pitch or range and a control means for varying the frequency characteristic of an acoustic means in accordance with the detection result may be arranged, so that the frequency characteristic of the acoustic apparatus may be variably controlled in accordance with the detected performance pitch or range. More specifically, in the case of the electrical musical instrument shown in FIG. 19, a piston driving means 204 is arranged as the control means, and the piston 203 is driven in accordance with the detection result of a pitch (or range) detection means 205 to change the volume V of the cavity 5, thereby changing the frequency characteristic. Thus, a musical instrument which has a musical tone effect which changes in real time in correspondence with an instrument performance can be provided unlike a conventional musical instrument. In this case, when a plurality of pitches or ranges are detected, it is preferable in terms of improvement of a bass sound characteristic that the frequency characteristic is controlled in correspondence with the lowest tone or range.

The operation of the driver 8, the vibrator 4, and the Helmholtz resonator is the same as that described with reference to FIG. 1 and the like.

The seventh to ninth embodiments exemplify a case wherein the third aspect of the present invention is applied to an electrical musical instrument. However, the third aspect can be applied to an electronic musical instrument. The electronic musical instrument comprises a tone generation instruction means such as a keyboard, a drum pad, a breath input device, or the like, and a musical tone forming means for electrically forming a musical tone signal instructed by the tone generation instruction means in place of a tone generation controller constituted by the tone generating device 2 and the tone generating circuit 7 shown in, e.g., FIG. 19. This electronic musical instrument is operated in the same manner as in FIG. 19, except that a musical tone signal upon performance is not obtained by converting a mechanical or acoustic vibration into an electrical signal but is formed by an electrical circuit such as a memory, oscillator, and the like.

Modification of Embodiments

The present invention is not limited to the above embodiments, and various changes and modifications may be made within the spirit and scope of the invention. For example, in the above embodiments, a duct having an opening port is used as an acoustic mass means constituting a resonator but the acoustic mass means may be a passive vibrating body such as a simple opening or drone cone.

In the above embodiments, a case wherein a negative impedance generator is used as a driving means has been exemplified. However, the driving means need only drive a vibrating body of a vibrator to cancel a counteraction therearound, and may be ar, MFB circuit disclosed in, e.g., Japanese Patent Publication No. Sho 58-81156.

Tenth Embodiment

Figure 23:
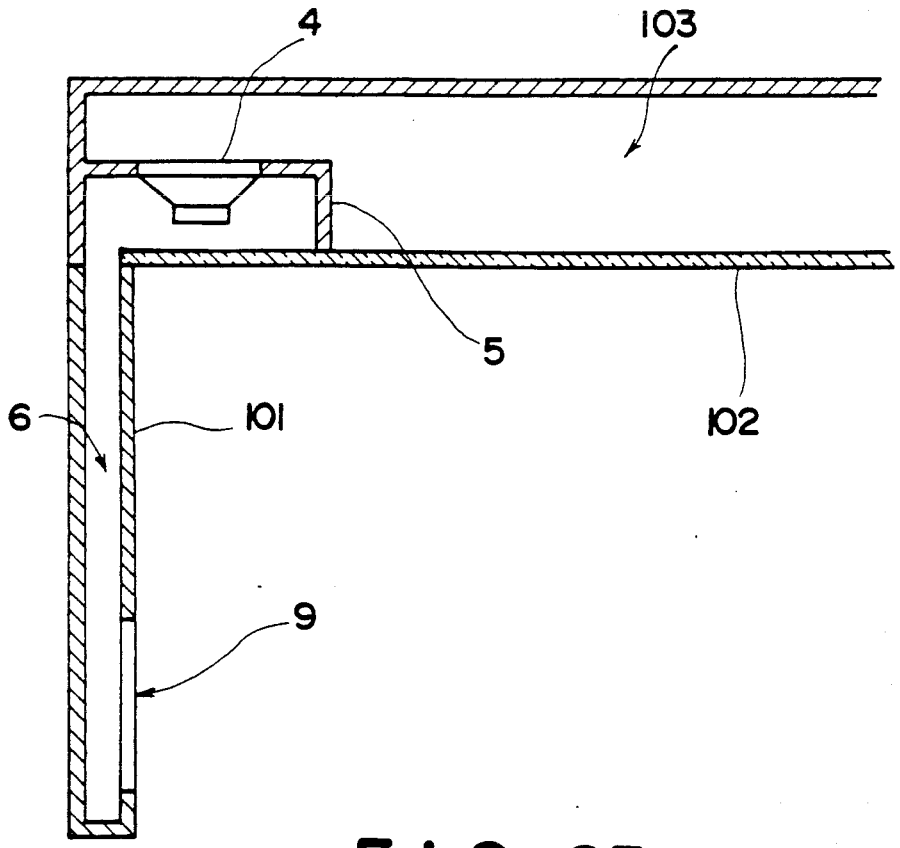
FIG. 23 is a sectional view showing an arrangement of a speaker system according to a tenth embodiment of the present invention.

FIG. 23 shows an arrangement of a speaker system of an electronic musical instrument according to a tenth embodiment of the present invention. In FIG. 10, a shelf plate 102 is supported at a predetermined level by a pair of upright side plates 101 (only one is shown). An electronic musical instrument main body 103 comprising a keyboard and an electrical circuit including a sound source and a speaker driving amplifier (neither of which are shown) is mounted on the shelf plate 102. A speaker box 5 provided with a speaker (unit) 4 is disposed in the electronic musical instrument main body 103.

A horn portion 6 of a back-loaded horn is formed in each side plate 101, and a horn opening portion 9 is formed in its lower inner portion. An input-side opening portion of the horn portion 6 is open to the speaker box 5 to be acoustically coupled thereto, and its output-side opening portion is open to the horn opening portion 9. The speaker 4, the speaker box 5, the horn portion 6, and the horn opening portion 9 form a back-loaded horn speaker system. As the horn portion 6, the interior of each side plate 101 may be partitioned by walls to form an elongated zig-zag channel, as shown in FIG. 14(*a*), or a member having a shape similar to a horn section of a musical instrument such as a horn may be appropriately bent to be housed in each side plate 101, as shown in FIG. 14(*b*).

In this electronic musical instrument, when the keyboard is operated and the speaker 4 is driven in accordance with a musical tone signal formed according to the keyboard operation, the speaker 4 directly radiates an acoustic signal corresponding to the musical tone signal from its front surface, and vibrates air in the speaker box with its back surface. The horn portion 6 is driven by this air vibration. Thus, the front surface of the speaker 4 mainly directly radiates an acoustic wave in a middle/high range, and the horn opening portion 9 mainly radiates an acoustic wave in a bass range having an output sound pressure characteristic according to the shape of the horn opening portion 9.

The back-loaded horn speaker system has good bass range efficiency, and can produce a bass sound well. When a back-loaded horn for constituting the back-loaded horn speaker system is formed in the side plates of the electronic musical instrument, design limitations are eliminated except that the thickness of each side plate is increased as compared to a conventional one. An increase in thickness of each side plate can provide a high-grade appearance, and is advantageous in terms of design.

Figure 24:
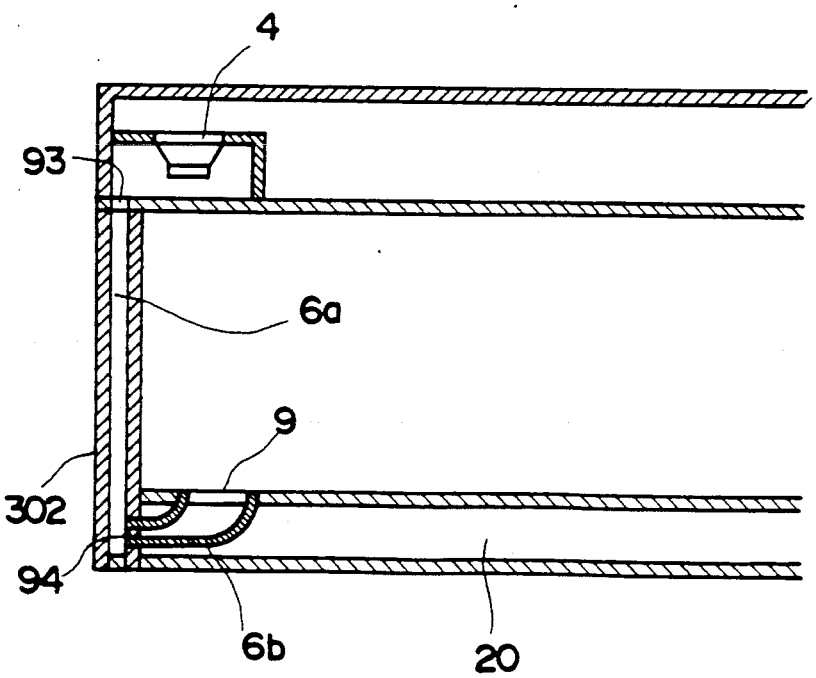
FIG. 24 is a sectional view of an electronic musical instrument according to an eleventh embodiment of the present invention.

FIG. 24 shows a case wherein the present invention is applied to an electronic musical instrument having a bottom portion 20 constituting a pedal box or the like. In FIG. 24, a back-loaded horn is divisionally formed such that a horn throat portion 6*a* is formed in each side plate 101 and a horn distal end portion 6*b* and a horn opening portion 9 are formed in the bottom portion 20. A speaker box 5 and the horn throat portion 6*a*, and the horn throat portion 6*a* and the horn distal end portion 6*b* are acoustically coupled to each other. Acoustic coupling portions 93 and 94 for these members may be spatially coupled through corresponding openings, as shown in FIG. 23, but may be spatially separated using passive vibrating bodies or the like.

The speaker system shown in FIG. 24 is operated in the same manner as that shown in FIG. 23. Bass range conversion efficiency can be improved without changing design or design can be simplified while maintaining sufficient efficiency. In particular, since a portion of the back-loaded horn is disposed in the bottom portion, the volume in each side plate can be reduced, and an increase in width or thickness of the side plate can be suppressed.

Application Range of the Invention

In the above embodiments, the present invention is applied to a stationary electronic musical instrument in which an electronic musical instrument main body and side plates are integrally fixed. The present invention is applicable to an electronic musical instrument consisting of only an electronic musical instrument main body like a portable electronic musical instrument. In this case, a back-loaded horn is formed in instrument stands or side plates of the instrument stands for supporting the electronic musical instrument. When the electronic musical instrument is placed on the instrument stands, the back-loaded horn can be coupled to the speaker box of the electronic musical instrument.

What is claimed is:

1. A musical instrument which houses a tone generation controlling apparatus for generating an electrical signal having a musical tone waveform according to a performance operation and an acoustic apparatus for converting the electrical signal into an acoustic wave and producing a sound, wherein said acoustic apparatus comprises:

a resonator comprising a cavity and acoustic mass means for causing said cavity to acoustically communicate with an external region;

a vibrator disposed in an outer wall of a housing which forms said cavity and has a vibrating body for driving said resonator with one surface thereof; and vibrator driving means for driving said vibrator to cancel a counteraction from said resonator to said vibrating body when said resonator is driven.

2. An electrical musical instrument comprising:

an instrument main body including a resonator;

a tone generating device for producing a mechanical vibration in accordance with a performance operation and driving said resonator;

a tone generating circuit for converting the mechanical vibration into an electrical signal; and an acoustic apparatus for converting the electrical signal into an acoustic wave and producing a sound, wherein said acoustic apparatus comprises:

said resonator or another resonator in which acoustic mass means is disposed in said resonator to change a resonance frequency;

a vibrator constituting a portion of said resonator and having a vibrating body for driving said resonator with one surface and directly radiating an acoustic wave from the other surface toward an external region of said instrument main body; and vibrator means for driving said vibrator to cancel a counteraction from said resonator to said vibrating body when said resonator is driven.

3. An electrical/electronic musical instrument comprising a leg portion, a performance section supported by said leg portion, a tone generation controlling apparatus for generating an electrical signal having a musical tone waveform according to an operation at said performance section, and an electro-acoustic transducer for converting the electrical signal into an acoustic wave and producing a sound, wherein said electro-acoustic transducer comprises:

a housing for forming a closed cavity;

a duct, formed in said leg portion, for causing said cavity to acoustically communicate with an external region;

a vibrator disposed in an outer wall of said housing and having a vibrating body for driving a resonator constituted by said cavity and said duct with one surface thereof; and vibrator driving means for driving said vibrator to cancel a counteraction from said resonator to said vibrating body when said resonator is driven.

4. An electrical/electronic musical instrument comprising a tone generation controlling apparatus for generating an electrical signal having a musical tone waveform according to a performance operation and an acoustic apparatus for converting the electrical signal into an acoustic wave and producing a sound, wherein said acoustic apparatus comprises:

a resonator constituted by a closed cavity and acoustic mass means for causing said cavity to acoustically communicate with an external region;

a vibrator constituting a portion of a housing forming said cavity and having a vibrating body for driving said resonator with one surface thereof;

vibrator driving means for driving said vibrator to cancel a counteraction from said resonator to said vibrating body when said resonator is driven; and control means for controlling at least one of said resonator and said vibrator driving means to vary a frequency characteristic of said acoustic apparatus.

5. A speaker for an electronic musical instrument, comprising:

a back-loaded horn which is formed in an instrument stand for supporting said electronic musical instrument, the back-loaded horn being acoustically coupled to a speaker box of said electronic musical instrument.

* * * * *